US011376875B2

(12) United States Patent
Kuronuma et al.

(10) Patent No.: US 11,376,875 B2
(45) Date of Patent: Jul. 5, 2022

(54) PRINTING APPARATUS, CONTROL METHOD OF PRINTING APPARATUS, AND STORAGE MEDIUM

(71) Applicant: CANON KABUSHIKI KAISHA, Tokyo (JP)

(72) Inventors: Daigo Kuronuma, Kawasaki (JP); Ryutaro Takahashi, Tokyo (JP); Naoaki Wada, Yokohama (JP); Tomohito Abe, Yokohama (JP); Noriyuki Aoki, Tokyo (JP); Ryohei Maruyama, Kawasaki (JP); Masakazu Nagashima, Yokohama (JP); Toshiaki Yamaguchi, Machida (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 115 days.

(21) Appl. No.: 16/831,861

(22) Filed: Mar. 27, 2020

(65) Prior Publication Data

US 2020/0307273 A1 Oct. 1, 2020

(30) Foreign Application Priority Data

Mar. 29, 2019 (JP) ..... JP2019-067048

(51) Int. Cl.

| | |
|---|---|
| ***B41J 11/66*** | (2006.01) |
| ***B41J 11/70*** | (2006.01) |
| ***B41J 11/68*** | (2006.01) |
| *B41J 11/00* | (2006.01) |

(52) U.S. Cl.

CPC ..... *B41J 11/663* (2013.01); *B41J 11/68* (2013.01); *B41J 11/70* (2013.01); *B41J 11/706* (2013.01); *B41J 11/007* (2013.01)

(58) Field of Classification Search

CPC . B41J 11/663; B41J 11/68; B41J 11/70; B41J 11/706

See application file for complete search history.

(56) References Cited

U.S. PATENT DOCUMENTS

| | | | |
|---|---|---|---|
| 4,684,962 | A | 8/1987 | Hirosawa et al. |
| 5,311,214 | A | 5/1994 | Hirasawa et al. |
| 5,339,098 | A | 8/1994 | Nagatomo et al. |
| 5,359,358 | A | 10/1994 | Shimamura et al. |

(Continued)

FOREIGN PATENT DOCUMENTS

JP 2006-334938 A 12/2006

*Primary Examiner* — Jill E Culler

(74) *Attorney, Agent, or Firm* — Venable LLP

(57) ABSTRACT

A printing apparatus including: a carriage having a print head and configured to be movable in an intersecting direction; a slitter unit configured to be movable in the intersecting direction and cut a roll sheet in a conveyance direction; a detection sensor mounted on the carriage and configured to detect a cut portion of the roll sheet that has been cut by the slitter unit; and a control unit configured to control the carriage to move after controlling the slitter unit to move and cut the roll sheet, so that the cut portion made by the slitter unit is detected by the detection sensor, and configured to control a moving distance of the carriage or the slitter, based on a first moving distance by which the slitter unit has moved and a second moving distance of the carriage at a timing where the detection sensor detects the cut portion.

20 Claims, 21 Drawing Sheets

(56) References Cited

U.S. PATENT DOCUMENTS

| | | | | |
|---|---|---|---|---|
| 5,548,308 | A | 8/1996 | Nagatomo et al. | |
| 5,576,744 | A | 11/1996 | Niikura et al. | |
| 5,757,403 | A | 5/1998 | Nagashima | |
| 5,790,168 | A * | 8/1998 | Sano | B65H 35/02 347/262 |
| 6,024,434 | A | 2/2000 | Shimamura et al. | |
| 6,142,599 | A | 11/2000 | Ishinaga et al. | |
| 6,151,051 | A | 11/2000 | Ikeda et al. | |
| 6,196,655 | B1 | 3/2001 | Hirasawa et al. | |
| 6,966,629 | B2 | 11/2005 | Nakajima et al. | |
| 7,144,093 | B2 | 12/2006 | Nakajima et al. | |
| 8,117,952 | B2 * | 2/2012 | Carpentier | B23Q 15/02 83/76.1 |
| 10,850,418 | B2 * | 12/2020 | Urrutia Nebreda | B26D 1/225 |
| 2012/0050405 | A1 | 3/2012 | Abe | |
| 2013/0208043 | A1 | 8/2013 | Kawakami et al. | |
| 2015/0217580 | A1 * | 8/2015 | Yamamoto | B41J 11/68 347/220 |
| 2016/0339721 | A1 | 11/2016 | Arai et al. | |
| 2019/0232641 | A1 | 8/2019 | Kuronuma et al. | |

* cited by examiner

PRINTING APPARATUS, CONTROL METHOD OF PRINTING APPARATUS, AND STORAGE MEDIUM

BACKGROUND OF THE INVENTION

Field of the Invention

The present invention relates to a printing apparatus, a control method of a printing apparatus, and a storage medium.

Description of the Related Art

A printing apparatus that conveys a roll sheet, which is a rolled-up printing medium, by use of a conveyance roller in a conveyance direction and prints an image is known. Japanese Patent Laid-Open No. 2006-334938 discloses a printing apparatus including a longitudinal direction cutter, which is movable in an intersecting direction orthogonal to the conveyance direction and is configured to cut a roll sheet in parallel to the conveyance direction, so as to cut the roll sheet in accordance with the size of an image.

In the printing apparatus, the positions of the longitudinal direction cutter and a print head in the intersecting direction are controlled with reference to the respective origins of the longitudinal direction cutter and the print head. The origin of the longitudinal direction cutter and the origin of the print head may be arranged at separated positions in the intersecting direction. Therefore, an error may occur in the relative position between the origin of the print head and the origin of the longitudinal direction cutter, due to change by aging, replacement of the longitudinal direction cutter, or the like. Therefore, there is a possibility that the relative position of the position to be cut by the slitter and a printed image made by the print head is shifted from the desired position.

SUMMARY OF THE INVENTION

A printing apparatus of the present invention includes: a conveyance unit configured to convey a printing medium in a conveyance direction; a printing unit configured to print an image on the printing medium; a carriage having the printing unit and configured to be movable in an intersecting direction, which intersects the conveyance direction; and a slitter configured to be movable in the intersecting direction and cut the printing medium in the conveyance direction, wherein the printing apparatus includes a detection unit, which is mounted on the carriage and configured to be able to detect a cut portion of the printing medium that has been cut by the slitter, wherein, after the slitter is controlled to move and cut the printing medium, the carriage is controlled to move, so that the cut portion is detected by the detection unit, and wherein the printing apparatus includes a control unit configured to control a moving distance of the carriage or the slitter, based on a first moving distance and a second moving distance, the first moving distance indicating a moving distance of the carriage at a timing where the detection unit detects the cut portion, the second moving distance indicating a moving distance of the slitter moved to cut the printing medium.

Further features of the present invention will become apparent from the following description of exemplary embodiments with reference to the attached drawings.

DESCRIPTION OF THE EMBODIMENTS

Hereinafter, an explanation is given of embodiments of the present invention with reference to the drawings. The following embodiments do not limit the present invention. Further, every combination of the characteristics explained in the present embodiments is not necessarily essential to the solution means of the present invention. The same reference sign is assigned for explanation of the identical configuration. In addition, relative positions, shapes, and the like, of the constituent elements described in the embodiments are merely examples and are not intended to limit the present invention to the range of the examples.

First Embodiment

Figure 1:
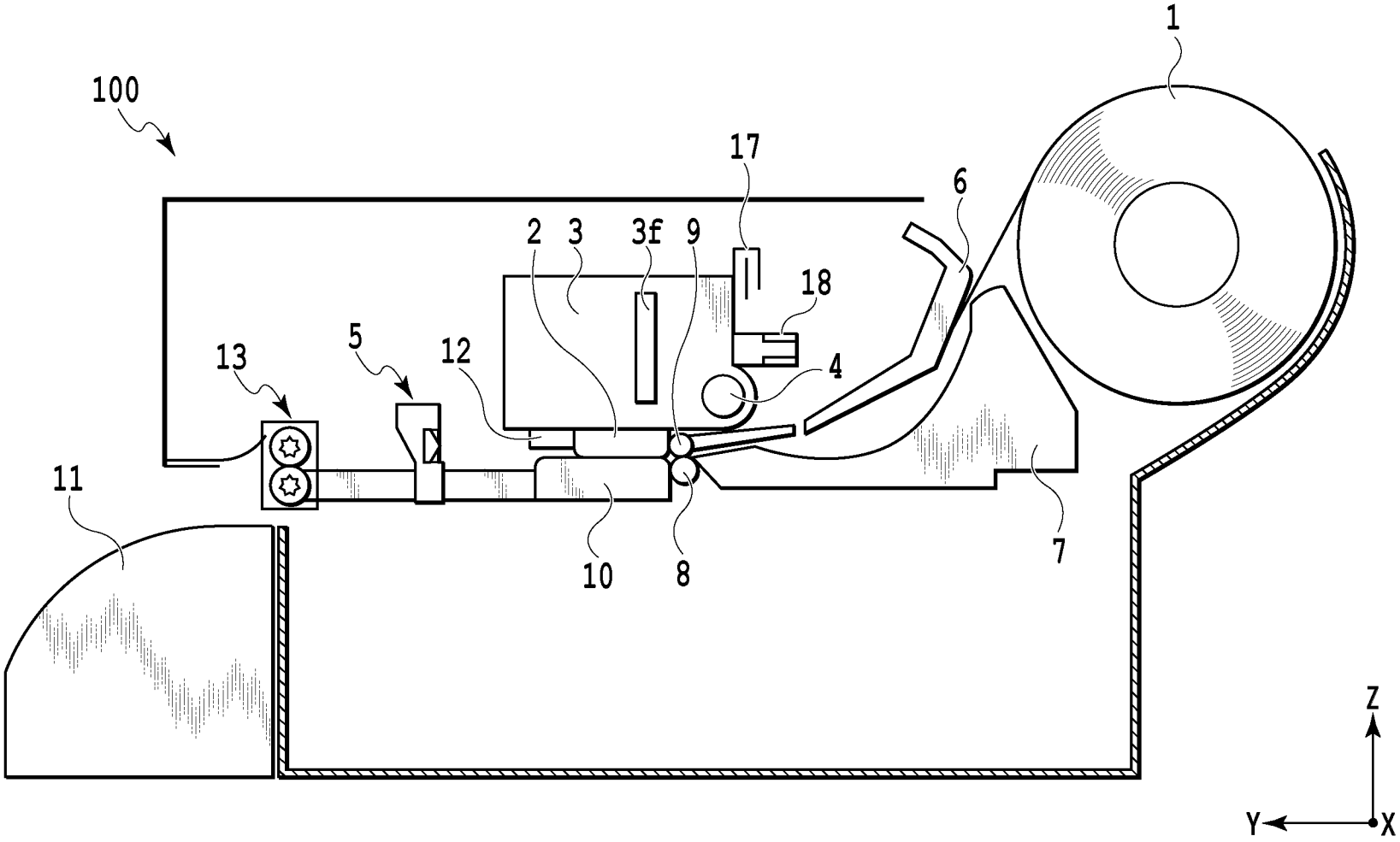
FIG. 1 is a cross-sectional view of a printing apparatus.

FIG. 1 is a cross-sectional view illustrating an example of an inkjet printing apparatus according to the present embodiment. The inkjet printing apparatus 100 (hereinafter referred to as the printing apparatus 100) performs printing on a printing medium that has a shape of a long sheet. In the present embodiment, the printing medium is a roll sheet 1. The roll sheet 1 held in the printing apparatus 100 is conveyed to the downstream through a conveyance path formed by the upper guide 6 and the lower guide 7. The roll sheet 1 is nipped by the conveyance roller 8 and the pinch roller 9 and conveyed to an image printing unit. The image printing unit is configured to include the print head 2, the carriage 3 on which the print head 2 is mounted, and the platen 10 disposed at a position facing the print head 2. The roll sheet 1 is conveyed onto the platen 10 by the conveyance roller 8. Ink is ejected by the print head 2 onto the roll sheet 1 conveyed to the image printing unit, so as to print an image.

The carriage 3 is supported so as to be able to perform a sliding motion along the guide shaft 4 and the guide rail 18 that are disposed in parallel to each other in the printing apparatus 100. The carriage 3 includes the reflection type detection sensor 12 facing the platen 10, so as to be able to detect the reflectivity of a spot position. That is, in a case where the platen 10 is black and the roll sheet 1 is white, the reflectivity of the platen 10 and the roll sheet 1 are greatly different. Therefore, it is possible to determine whether the platen 10 is present or the roll sheet 1 is present at the spot position by use of the detection sensor 12. It is possible to detect the leading edge of the roll sheet 1 by utilizing the fact that, while the roll sheet 1 is conveyed by the conveyance roller 8, the reflectivity greatly changes in a case where the leading edge of the roll sheet 1 in the conveyance direction passes through the spot position of the detection sensor 12.

The carriage 3 scans in the X direction along the guide shaft 4 while holding the print head 2, and the print head 2 ejects ink while the carriage 3 scans, so as to perform printing on the roll sheet 1. After a scan by the carriage 3 to perform printing on the roll sheet 1, the conveyance roller 8 conveys the roll sheet 1 by a predetermined amount, and the carriage 3 scans on the roll sheet 1 again to perform printing. In this way, by repeating printing and conveying, the entire printing is completed. Furthermore, since the detection sensor 12 is mounted on the carriage 3, the positions of the paper edges in the intersecting direction (X direction) of the roll sheet 1 can also be detected by the reciprocating operation of the carriage 3.

On the downstream relative to the carriage 3 in the conveyance direction of the roll sheet 1, there is provided the cutter 5 for cutting the roll sheet 1 in a direction (X direction) intersecting the conveyance direction, and, on the further downstream, there is provided the slitter 13 for cutting the roll sheet 1 along the conveyance direction. On the downstream relative to the slitter 13, there is provided the discharging guide 11 for discharging the roll sheet 1 that is cut.

The cutter 5 includes a cutter unit 300 as a cutting mechanism for cutting the roll sheet 1 and a unit for moving the cutter unit 300 along the X direction. Furthermore, the slitter 13 includes a slitter unit 303 as a cutting mechanism for cutting the roll sheet 1 and a unit for moving the slitter unit 303 along the X direction.

Figure 2:
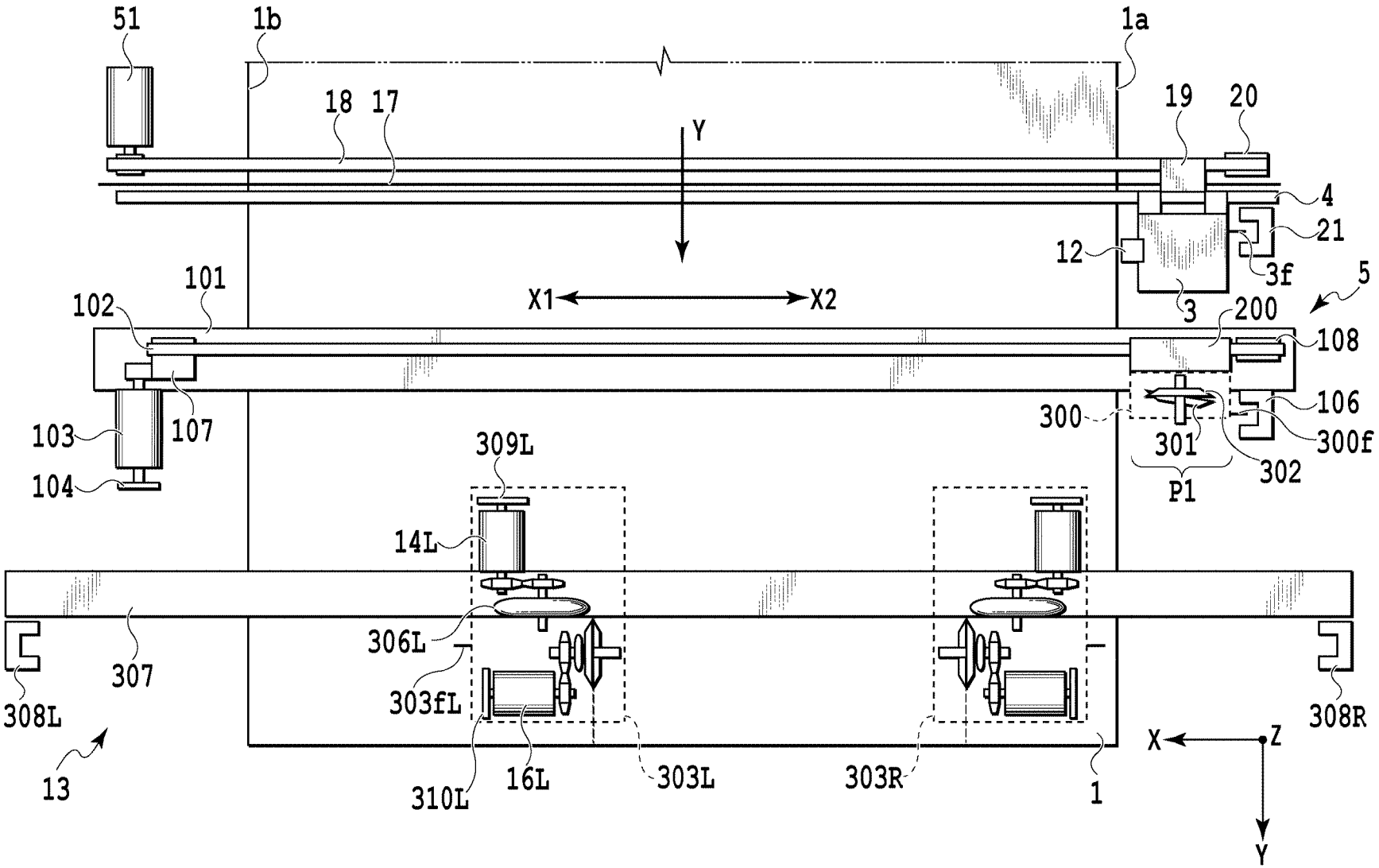
FIG. 2 is a top view of the printing apparatus for explaining a carriage and a slitter.

FIG. 2 is a top view for explaining the carriage encoder 19, the cutter 5, and the slitter 13 including the slitter units 303L and 303R. In the present specification, "L" and "R" at the end of the reference signs indicate a member on the left side (that is, +X side) and a member on the right side (that is, −X side) on the drawings, respectively. In the present specification, such an end of a reference sign may be omitted in a case of members that are the same on the left side and the right side.

The movement of the carriage 3 is controlled based on the number of pulses, which is obtained by the carriage encoder 19 attached to the carriage 3 and configured to read a slit arranged on the linear scale 17. The relationship between the number of pulses obtained by the carriage encoder 19 and the moving distance of the carriage 3 is predetermined. Therefore, by detecting the moving distance of the carriage 3 by use of the carriage encoder 19, it is possible to move the carriage 3 by a desired moving distance in the X1 and X2 directions. Furthermore, the carriage 3 includes a carriage flag 3*f*, and a carriage origin sensor 21 that is able to detect the carriage flag 3*f* is provided at one end of the scanning area of the carriage 3. The carriage flag 3*f* is a flag member for position detection, and the carriage origin sensor 21 is configured to be able to detect the carriage flag 3*f* disposed on the carriage 3. The position at which the carriage origin sensor 21 detects the carriage flag 3*f* disposed on the carriage 3 is the origin position, which is the starting point of the moving distance of the carriage 3.

The guide rail 101 is configured to guide the cutter carriage 200 in the direction intersecting the conveyance direction of the roll sheet 1. The cutter carriage 200 integrally connects the cutter unit 300 and the belt 102. Furthermore, the belt 102 is configured to bridge the motor pulley 107 and the tensioner pulley 108 disposed on the left and right sides of the guide rail 101 and is configured to be moved by the cutter motor 103 connected to the motor pulley 107. The cutter motor 103 is provided with the cutter encoder 104. The cutter encoder 104 counts the number of pulses corresponding to driving of the cutter motor 103. Furthermore, at the stand-by position P1 of the cutter unit 300, there is the cutter origin sensor 106. Based on the number of pulses obtained by the cutter encoder 104 from the starting point which corresponds to detection of the flag 300*f* disposed on the cutter unit 300 by use of the cutter origin sensor 106, it is possible to control the movement position of the cutter unit 300 in the X1 and X2 directions.

The cutter unit 300 includes the upper movable blade 301 and the lower movable blade 302, so that the roll sheet 1 is cut at the contact point of the upper movable blade 301 and the lower movable blade 302 while the cutter unit 300 moves in the X1 direction. Furthermore, the upper movable blade 301 and the lower movable blade 302 are connected to the cutter motor 103 via the belt 102 and the cutter carriage 200 and are configured to be rotationally driven. In a case where the roll sheet 1 is cut, the roll sheet 1 is cut while the lower movable blade 302 and the upper movable blade 301, which is in contact with the lower movable blade 302, rotate together. In the example of FIG. 2, the cutter unit 300 performs cutting from the first end 1*a* of the roll sheet 1 to the second end 1*b* of the roll sheet 1. The first end 1*a* of the roll sheet 1 is an end on the stand-by position P1 side of the cutter unit 300. After the roll sheet 1 is cut, the cutter carriage 200 is reversed at a predetermined reversing position. Further, the cutter carriage 200 moves to a position that is the stand-by position P1 to stand by for the next cutting operation. Although the cutter unit 300 is mounted on the cutter carriage 200 in the example of the present embodiment, the cutter unit 300 may be mounted on the carriage 3 that moves the print head 2, etc., for example. In addition, there may be a form in which cutting can be performed from the second end 1*b* of the roll sheet 1 toward the first end 1*a* of the roll sheet 1. Furthermore, for example, there may be a form in which the cutter 5 is able to cut the roll sheet 1 from either one of the second end 1*b* and the first end 1*a*.

Alternatively, there may be a form in which a cutter that is able to cut the roll sheet 1 in the X direction from the second end 1*b* is further included.

The slitter 13 is disposed on the downstream side relative to the cutter 5 in the conveyance direction of the roll sheet 1. A slitter unit 303 of the slitter 13 is movable to a given position in the X1 and X2 directions and is able to cut the roll sheet 1 along the direction parallel to the conveyance direction (+Y direction). In the present embodiment, an explanation is given of a configuration in which two slitter units 303 are mounted. That is, an explanation is given of the example in which the slitter unit 303L and the slitter unit 303R are mounted. The slitter units 303L and 303R have the same configuration with the components that are left-right reversals in the X1 and X2 directions. In FIG. 2, for the sake of simplification, reference signs are mainly assigned to the components of the slitter unit 303L.

The moving distances of the slitter units 303L and 303R can be detected based on the number of pulses from the slitter moving encoders 309L and 309R, which are attached to the slitter moving motors 14L and 14R, respectively. Therefore, it is possible to control each of the slitter units 303 to move by a desired moving distance in the X1 and X2 directions. Furthermore, on both ends of the slitter guide rail 307 in the direction orthogonal to the conveyance direction, the slitter origin sensors 308L and 308R are provided, respectively. Moreover, the slitter units 303L and 303R include the slitter flags 303*f*L and 303*f*R as flag members, respectively. The position of the slitter unit 303L at a timing where the slitter origin sensor 308L detects the slitter flag 303*f*L is the origin position, which is the starting point of the moving distance of the slitter unit 303L. The origin position of the slitter unit 303R is similarly determined.

Figure 3A:
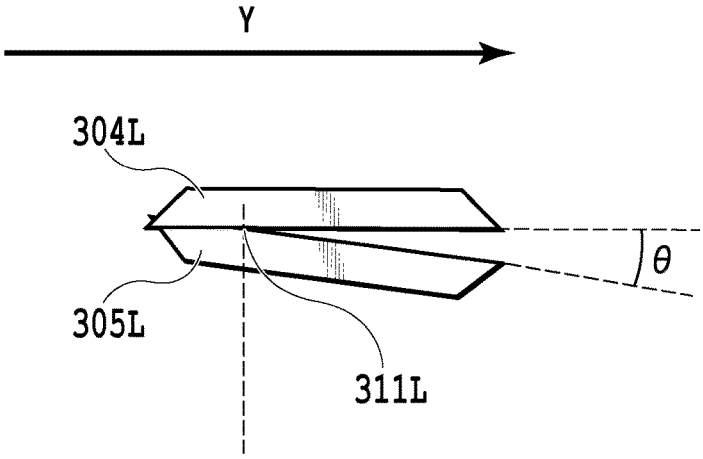
FIG. 3A is a top view for explaining a slitter unit.
Figure 3B:
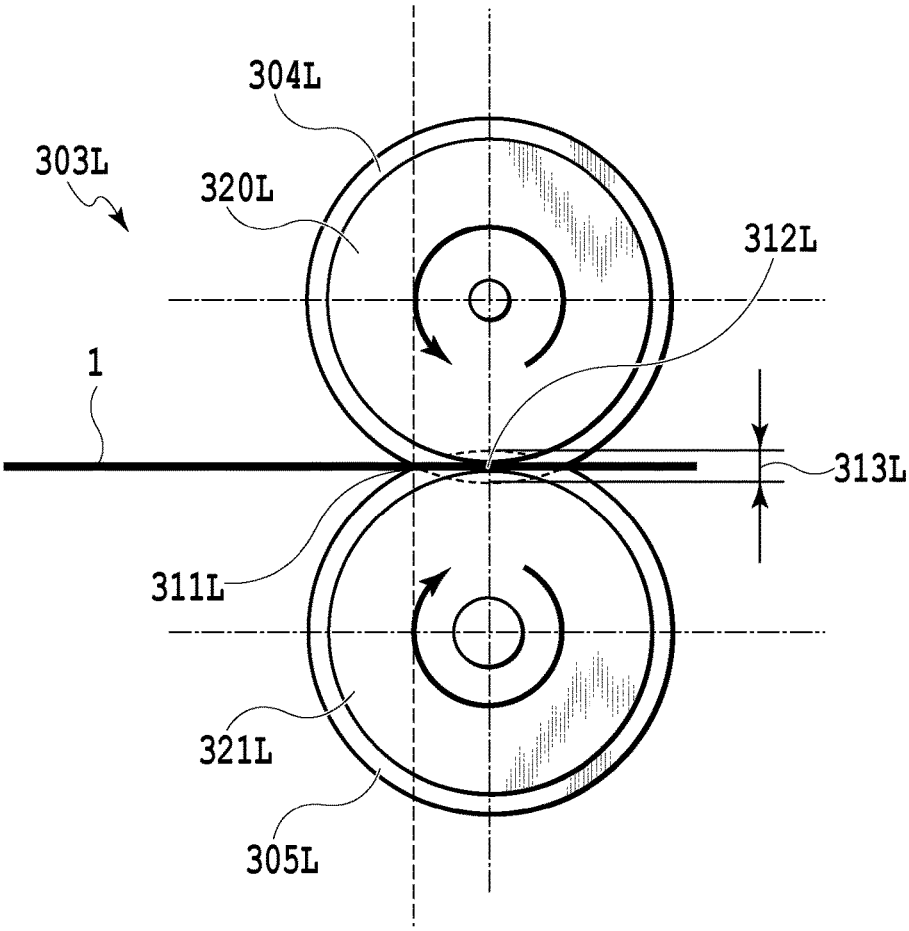
FIG. 3B is a side view for explaining the slitter unit.
Figure 4:
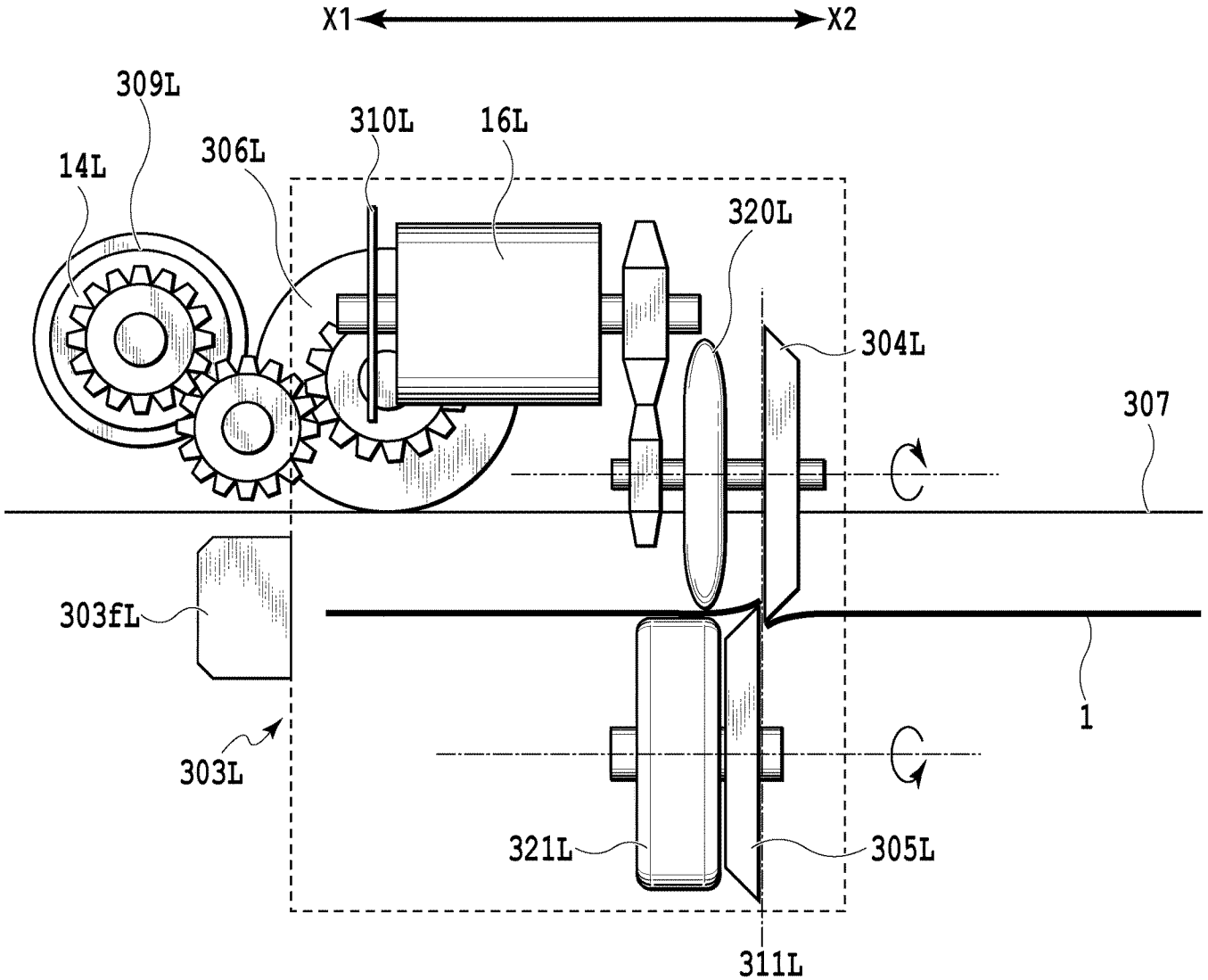
FIG. 4 is a front view for explaining the slitter unit.

FIGS. 3A and 3B and FIG. 4 are diagrams for explaining details of the slitter unit 303L. FIG. 3A is a schematic top view of the slitter unit 303L, and FIG. 3B is a schematic side view of the slitter unit 303L. The slitter unit 303L includes the slitter upper movable blade 304L and the slitter lower movable blade 305L. The slitter upper movable blade 304L and the slitter lower movable blade 305L are disposed so as to have a round blades overlap amount 313L in the vertical direction and have a predetermined amount of angle (intersect angle) θ relative to the conveyance direction Y, which is the cutting direction. The roll sheet 1 is cut at the contact point 311L of the slitter upper movable blade 304L and the slitter lower movable blade 305L. The slitter upper movable blade 304L is connected to the slitter driving motor 16L via a gear.

In a case where the slitter upper movable blade 304L is rotated by the driving force of the slitter driving motor 16L, the slitter upper conveyance roller 320L, which is connected coaxially with the slitter upper movable blade 304L, rotates as well. The outer diameter of the slitter upper conveyance roller 320L is in contact with the outer diameter of the slitter lower conveyance roller 321L, which is connected coaxially with the slitter lower movable blade 305L, at the roller nip point 312L. Thus, by driving with friction transmission, while the roll sheet 1 is conveyed by the slitter upper conveyance roller 320L and the slitter lower conveyance roller 321L, the upper and lower blades rotate together to cut the roll sheet 1 in the conveyance direction. Since the slitter driving motor 16L is provided with the slitter driving encoder 310L, it is possible to control the slitter driving motor 16L with a predetermined rotation speed and a predetermined rotation amount. The slitter driving motor 16L is controlled to drive at a driving amount (specifically, a rotation speed and a rotation amount), which is synchronized with and corresponding to the conveyance amount by the conveyance roller 8.

The slitter unit 303L includes the slitter moving motor 14L and is configured such that driving force is transmitted to the slitter moving roller 306L via a gear. The slitter moving roller 306L abuts on the slitter guide rail 307, and the slitter unit 303L is configured to be movable in the X1 and X2 directions by friction between the front surface of the slitter moving roller 306L and the slitter guide rail 307. In other words, the slitter upper movable blade 304L, the slitter lower movable blade 305L, the slitter upper conveyance roller 320L, and the slitter lower conveyance roller 321L are integrally movable along the slitter guide rail 307.

Although the slitter moving roller 306L is driven with friction in the present embodiment, the slitter moving roller 306L may have a rack and pinion configuration with a slitter moving roller serving as a pinion and a slitter guide rail serving as a rack.

Next, an explanation is given of general operation of cutting by the slitter units 303. First, the slitter units 303L and 303R are moved to cutting positions, and the roll sheet 1 is conveyed by the conveyance roller 8 while the conveyance motor 51 and the slitter driving motors 16L and 16R are driven at the same speed. In a case where the leading edge of the roll sheet 1 reaches the contact points 311L and 311R of the slitter 13, the roll sheet 1 is cut by the slitter upper movable blades 304L and 304R and the slitter lower movable blades 305L and 305R on the left and right sides. Furthermore, the roll sheet 1 is nipped and conveyed by the slitter upper conveyance rollers 320L and 320R and the slitter lower conveyance rollers 321L and 321R on the left and right sides while being cut, so as to be discharged through the discharging guide 11.

Additionally, cutting by the slitter units 303 can be performed together with image printing. The slitter units 303 move from the stand-by positions to predetermined cutting positions in the X1 and X2 directions according to the setting by the user.

Then, the roll sheet 1 is conveyed by the conveyance roller 8 while the conveyance motor 51 and the slitter driving motors 16L and 16R are driven at the same speed. In the image printing unit, in response to forward or return scanning of one line by the carriage 3 for printing an image, the roll sheet 1 is conveyed by the conveyance roller 8 and the pinch roller 9 by a predetermined pitch. Then, the carriage 3 is moved again to perform image printing of the next line. In a case where printing proceeds and the leading edge of the roll sheet 1 reaches the contact points 311, the roll sheet 1 is cut by the slitter upper movable blades 304L and 304R and the slitter lower movable blades 305L and 305R that are rotating. Furthermore, the roll sheet 1 is nipped and conveyed by the slitter upper conveyance rollers 320L and 320R and the slitter lower conveyance rollers 321L and 321R while being cut. Then, the image printing ends and the cutting by the slitter units 303 ends. Subsequently, the slitter units 303 move to the predetermined stand-by positions. The roll sheet 1 is conveyed up to a cutting position where the cutter unit 300 can cut the roll sheet 1, then the roll sheet 1 is cut by the cutter unit 300, so as to be discharged through the discharging guide 11.

The configuration of the slitter 13 described above is merely an example. That is, the slitter 13 may have any configuration as long as the slitter 13 is movable in the intersecting direction of the roll sheet 1 and is able to cut the conveyed roll sheet 1 in the conveyance direction at a given position of the intersecting direction. Further, there may be a form in which the slitter upper conveyance rollers 320 and the slitter lower conveyance rollers 321, the slitter upper movable blades 304, and the slitter lower movable blades 305 are independently driven. In a case where the slitter upper movable blades 304 and the slitter lower movable blades 305 are used for a predetermined time period, the slitter upper movable blades 304 and the slitter lower movable blades 305 may be worn. In such a case, the user may exchange the slitter upper movable blades 304 and the slitter lower movable blades 305.

Figure 5:
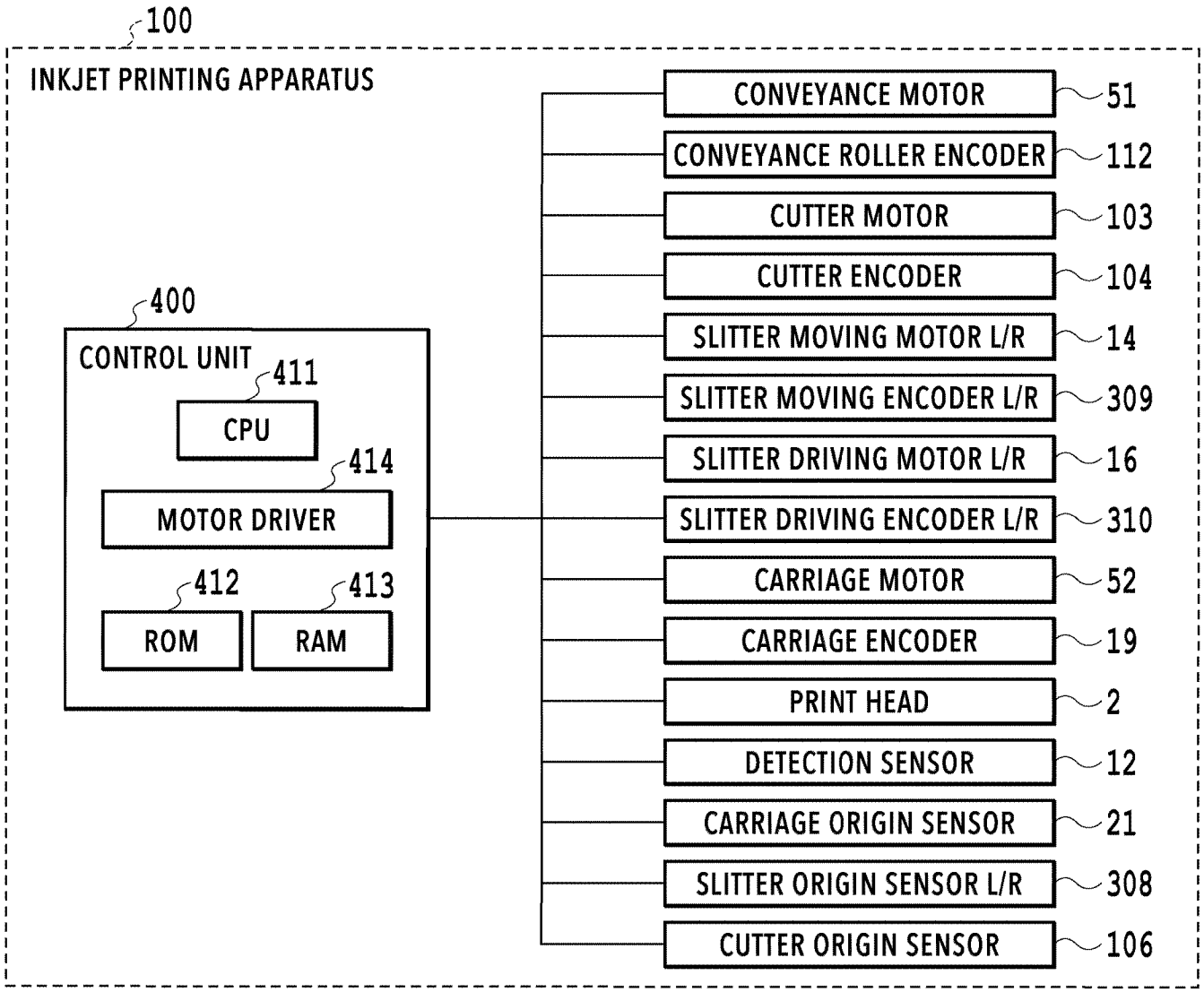
FIG. 5 is a block diagram for explaining a control system of the printing apparatus.

FIG. 5 is a schematic block diagram illustrating a control configuration of the printing apparatus 100. The printing apparatus 100 includes a control unit 400. Furthermore, the control unit 400 includes a CPU 411, a ROM 412, a RAM 413, and a motor driver 414. The control unit 400 implements control of a conveyance motor 51, a cutter motor 103, a slitter moving motor 14, a slitter driving motor 16, a carriage motor 52, and a print head 2. The control unit 400 obtains signals from a conveyance roller encoder 112, a cutter encoder 104, a slitter moving encoder 309, a slitter driving encoder 310, a carriage encoder 19, and a detection sensor 12. Furthermore, the control unit 400 obtains signals from a carriage origin sensor 21, a slitter origin sensor 308, and a cutter origin sensor 106. Furthermore, the control unit 400 controls the various motors and the print head 2, based on the signals.

[Control of Movement of the Slitter]

Figure 6:
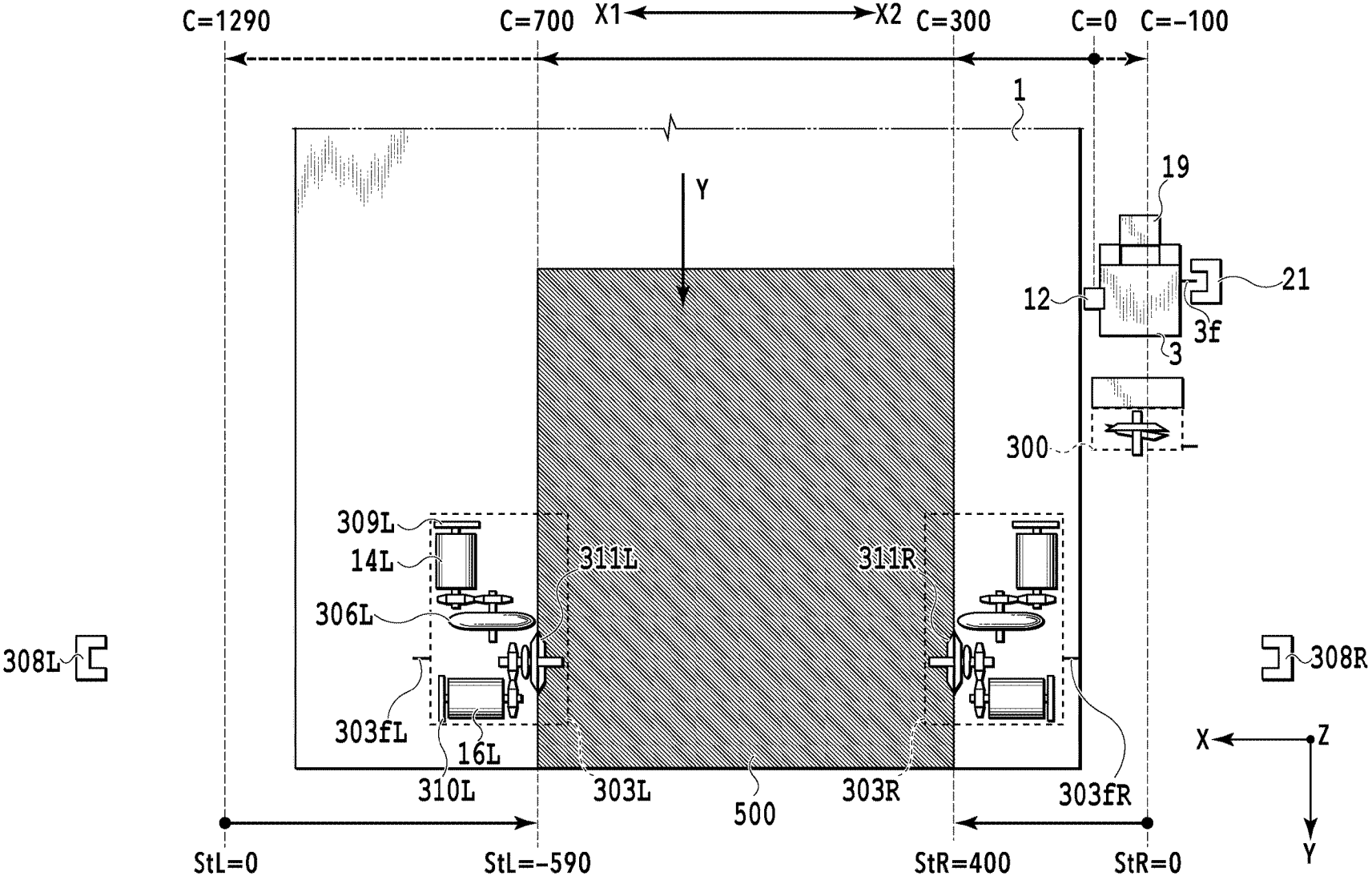
FIG. 6 is a diagram for explaining how the slitter moves in accordance with the position of the carriage.

FIG. 6 is a diagram similar to the top view of FIG. 2. With reference to FIG. 6, an explanation is given of an example of controlling the moving distances of the slitter units 303. The moving distance of the carriage 3 is represented as a moving distance C, the moving distance of the slitter unit 303R is represented as a moving distance StR, and the moving distance of the slitter unit 303L is represented as a moving distance StL, respectively. Since the carriage 3 and the slitter units 303 each have an individual encoder and motor for movement, the moving distances C, StL, and StR are individually managed.

The origins, which are the starting points for detecting the moving distances, are represented as "C=0" for the moving distance C, "StR=0" for the moving distance StR, and "StL=0" for the moving distance StL. The printing apparatus 100 includes the slitter origin sensors 308L and 308R and the carriage origin sensor 21. Further, the origins of the moving distances are determined with reference to the respective origin sensors. Since the respective origin sensors are disposed at different positions of the printing apparatus 100, the origin positions for detecting the respective moving distances of the slitter units 303R and 303L and the carriage 3 are different in the X direction, as illustrated in FIG. 6.

In the explanation of the present embodiment, the position of the detection sensor 12 corresponds to the position of the carriage 3. Furthermore, in the explanation, the position of the contact point 311L corresponds to the position of the slitter unit 303L, and the position of the contact point 311R corresponds to the position of the slitter unit 303R. Moreover, regarding each of the moving distances C, StL, and StR, movement in the X1 direction of FIG. 6 is detected as a positive value and movement in the X2 direction of FIG. 6 is detected as a negative value. Additionally, in the following explanation, the units for the values represented as the respective moving distances C, StL, and StR are the same.

In the configuration of the printing apparatus of FIG. 6, the origin "StL=0" of the slitter unit 303L is positioned on the downstream (+Y direction) of the position of the carriage in the conveyance direction in a case where the carriage is moved such that the value of the moving distance C becomes 1290 (C=1290). Similarly, in the configuration, it is assumed that "StR=0", which is the origin of the moving distance of the slitter unit 303R, corresponds to "−100" of the moving distance C (C=−100) of the carriage. By use of the positional relationship of the carriage 3 and the slitter units 303, it is possible to move the slitter units 303 in accordance with the size of the image printed by the print head, which is mounted on the carriage, so that the slitter 13 can cut the roll sheet 1 according to the image size.

For example, as illustrated in FIG. 6, it is assumed that an image is printed between the position of the carriage 3 that is moved such that the moving distance C becomes 300 (C=300) and the position of the carriage 3 that is moved such that the moving distance C becomes 700 (C=700). Therefore, the right end of the printed image 500, which is at the position corresponding to "C=300", is cut by the slitter unit 303R, and the left end of the printed image 500, which is at the position corresponding to "C=700", is cut by the slitter unit 303L. Then, it is assumed that the borderless printed image 500 is separated from the roll sheet 1, so that a printed subject is generated. Each of the moving distances StL and StR of the slitter units 303 corresponding to a given moving distance C of the carriage 3 is calculated by subtracting the moving distance of the carriage 3 corresponding to the origin position of each slitter unit 303 from the given moving distance C of the carriage 3. Therefore, the moving distance StL of the slitter unit 303L corresponding to the moving distance "C=700" of the carriage as illustrated in FIG. 6 can be obtained as follows.

$$StL=700-1290=-590$$

Similarly, the moving distance StR of the slitter unit 303R corresponding to the moving distance "C=300" of the carriage can be obtained as follows.

$$StR=300-(-100)=400$$

The control unit 400 controls the slitter unit 303L to move such that the value of the moving distance StL becomes −590 (StL=−590) and controls the slitter unit 303R to move such that the value of the moving distance StR becomes 400 (StR=400). With such control, it is possible to cut the roll sheet 1 by use of the slitter 13 according to the X directional size of the printed image 500.

Figure 7:
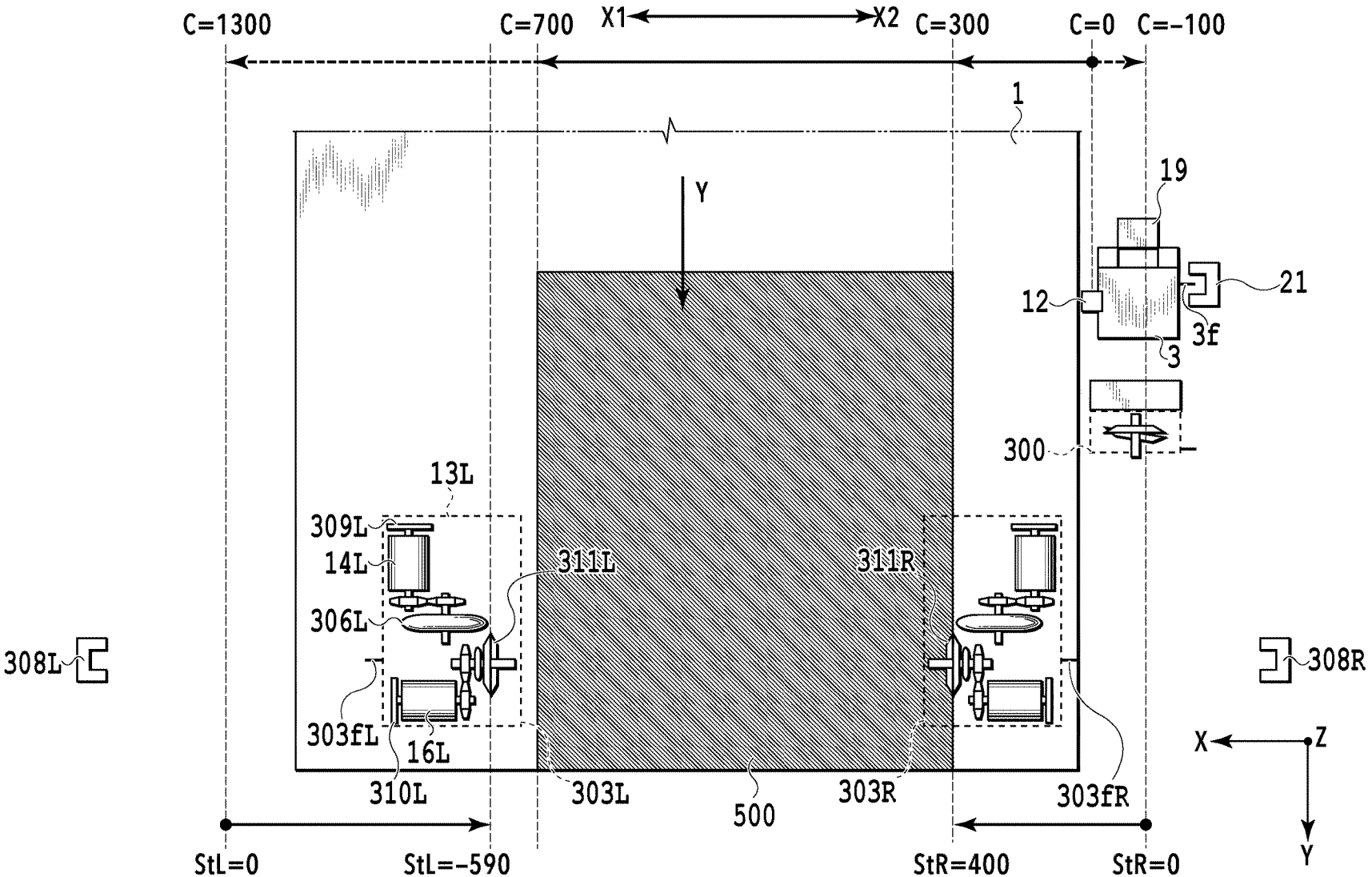
FIG. 7 is a diagram for explaining how the slitter moves in accordance with the position of the carriage.

FIG. 7 is a diagram similar to the top view of FIG. 6. As a comparative example, an explanation is given of the example in which the controlled relative positions of the carriage 3 and a slitter unit 303 are different from the actual relative positions, due to a deviation of the size of a part, misalignment in assembly, aging, replacement of parts, etc., with reference to FIG. 7. In the comparative example, as with FIG. 6, it is assumed that, for controlling, the origin "StL=0" of the slitter is set to correspond to the downstream of the carriage in the conveyance direction in a case where the carriage is moved such that the moving distance C becomes 1290 (C=1290). Therefore, as in the case of FIG. 6, the control unit 400 moves the slitter unit 303L by the moving distance "StL=−590" so that the slitter unit 303L is positioned at the left end of the printed image 500.

However, in the printing apparatus of the comparative example, the controlled relative positions of a slitter unit 303 and the carriage 3 are different from the actual relative positions, due to a deviation of the size of a part, misalignment in assembly, aging, replacement of parts, etc. That is, it is assumed that the origin "StL=0" of the slitter is actually at the position corresponding to the carriage 3 that is moved such that the moving distance C becomes 1300, as illustrated in FIG. 7. Therefore, in the comparative example, the X directional position of the slitter unit 303L in a case where the slitter is moved by the moving distance "StL=−590" does not match the X directional position of the carriage 3 that is moved by the moving distance "C=700". Therefore, in the comparative example, in a case where the slitter unit 303L is moved by the moving distance of "StL=−590" and cuts the roll sheet 1, the roll sheet 1 is cut at the position away from the left end of the printed image 500 by the distance corresponding to the moving distance of "10". Therefore, in the comparative example, cutting cannot be performed at a desired position of the printed image 500.

Figure 8:
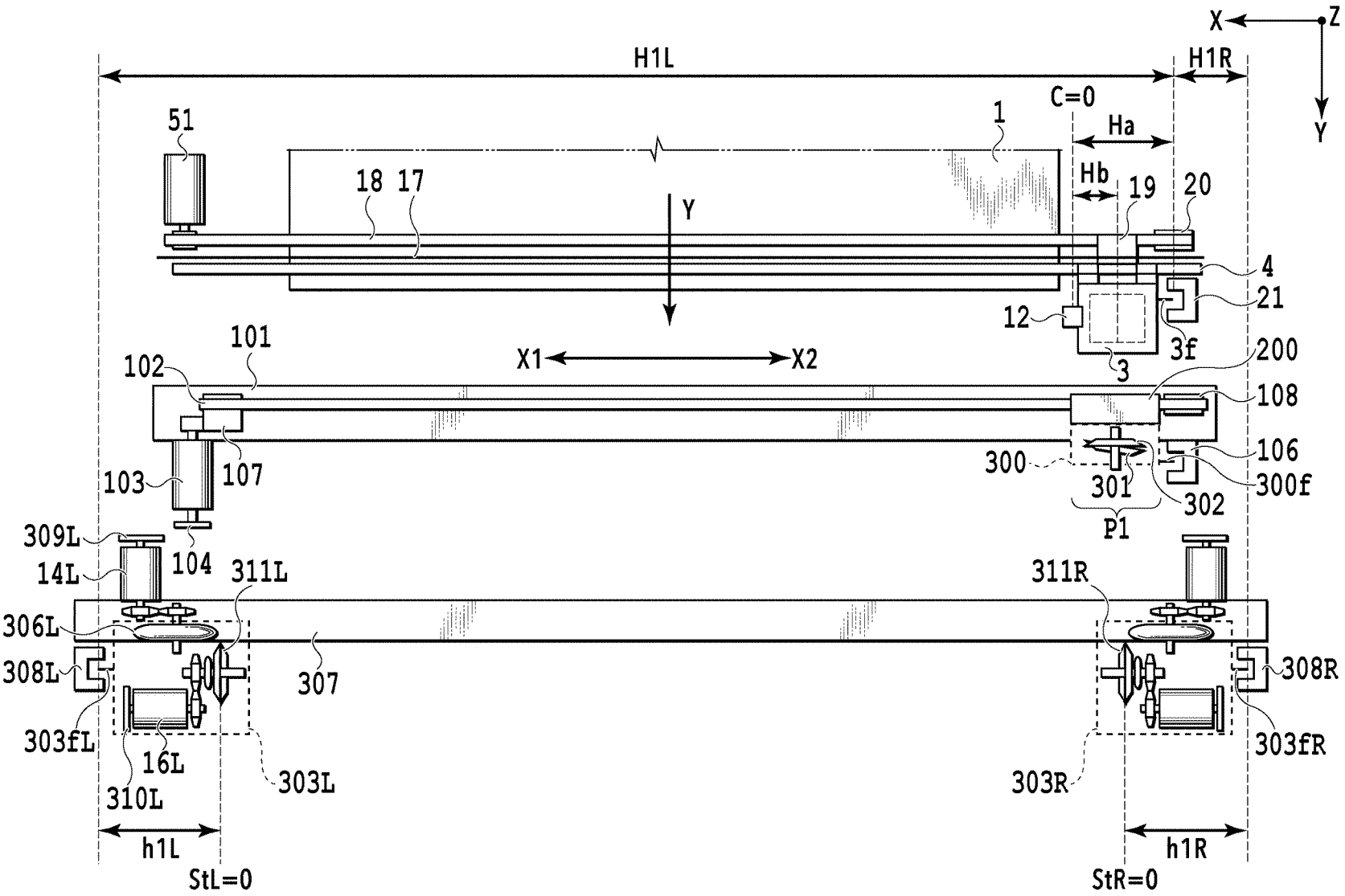
FIG. 8 is a diagram for explaining a positional relationship between the carriage and the slitter.

FIG. 8 is a top view similar to FIG. 2. The slitter unit 303L in FIG. 8 is taken as an example for explaining the positional relationship of the slitter units 303 and the carriage 3. As illustrated in FIG. 8, the distance h1L is from the contact point 311L to the slitter flag 303*f*L, the distance H1L is from the slitter origin sensor 308L to the carriage origin sensor 21, and the distance Ha is from the carriage origin sensor 21 to the detection sensor 12. Based on the distances designed as described above, the distance from the detection sensor 12, which is the reference of the position of the carriage 3, to the contact point 311L, which is the reference of the position of the slitter unit 303L, is obtained. Then, as explained in FIG. 6, based on the value ("C=1290" in FIG. 6) of the moving distance C for the carriage 3 to move the distance, it is possible to move the slitter unit 303L to the position corresponding to the position of the carriage 3.

However, there are multiple parts between each of the distance h1L from the contact point 311L to the slitter flag 303*f*L and the distance H1L from the slitter origin sensor 308L to the carriage origin sensor 21. Similarly, there are multiple parts in the distance Ha between the carriage origin sensor 21 and the detection sensor 12. Therefore, there is a possibility that the designed lengths of the respective distances h1L, H1L, and Ha are different from the actual lengths, due to variations in dimensions of parts between the respective distances and variation in assembly, etc. In addition, there is a possibility that the originally designed lengths of the respective distances h1L, H1L, and Ha are different from the actual lengths, due to change by aging or replacement of a slitter upper movable blade 304 and a slitter lower movable blade 305, etc. Therefore, in a case where the slitter unit 303L is moved with reference to the designed position of the carriage 3, the position of a slitter unit 303 may be shifted from a desired position as in the comparative example.

Therefore, as described below, the present embodiment is a form of performing correction on a controlled moving distance, which is used for moving the carriage 3 to the position corresponding to the origin position of a slitter unit 303.

[Correction of the Moving Distances of the Carriage Corresponding to the Origin Positions of the Slitter]

Figure 9:
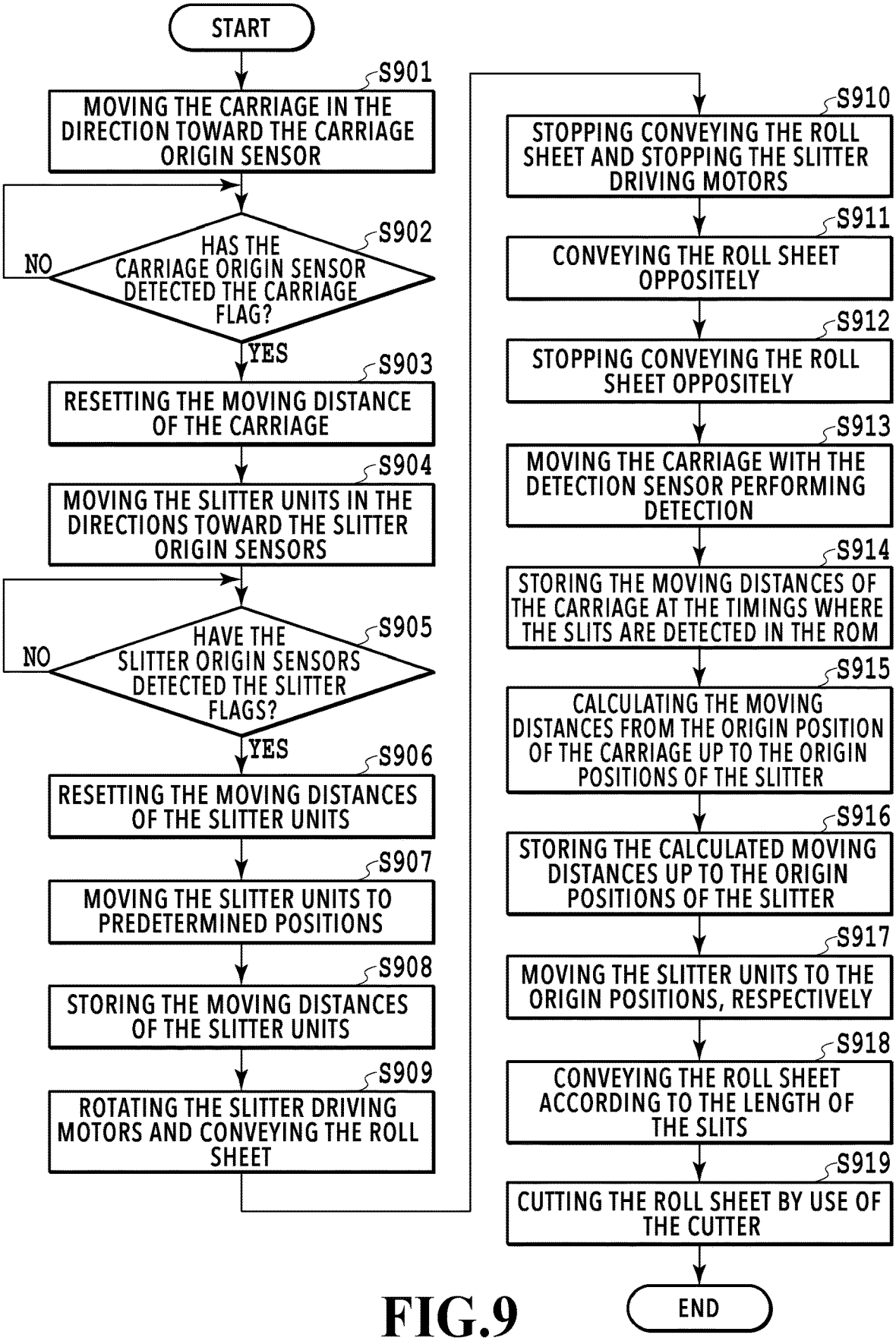
FIG. 9 is a flowchart of processing for correcting moving distances of the carriage, which are to be references.

FIG. 9 is a flowchart illustrating details of a series of processes for correcting controlled moving distances of the carriage 3 corresponding to the origin positions of the slitter units 303. The series of processes illustrated in the flowchart of FIG. 9 is performed by the CPU retrieving a program code stored in the ROM into the RAM and executing the program code. Furthermore, a part or all of the functions in the steps of FIG. 9 may be implemented by hardware such as an ASIC or an electronic circuit. The symbol "S" in the explanation of each process means that it is a step in the flowchart, and the same applies to the following flowcharts. In addition, FIGS. 10 through 13 and FIG. 15 are diagrams similar to the top view of FIG. 2 and are diagrams for explaining each of the processes in the present flowchart.

In S901, the control unit 400 moves the carriage 3 in the direction toward the carriage origin sensor 21.

In S902, the control unit 400 determines whether the carriage origin sensor 21 has detected the carriage flag 3*f*, which is attached to the carriage 3. It is indicated that the carriage origin sensor 21 in FIG. 8 is in a state of having detected the carriage flag 3*f*.

In a case where it is determined that the carriage origin sensor 21 has detected the carriage flag 3*f*, the control unit 400 stops the carriage 3 and resets the value of the moving distance C of the carriage 3 to "0" in S903. That is, the moving distance C of the carriage is updated such that the position of the carriage 3 at the timing of the detection by the carriage origin sensor 21 becomes the origin "C=0".

In S904, the control unit 400 moves the slitter unit 303L in the direction toward the slitter origin sensor 308L and moves the slitter unit 303R in the direction toward the slitter origin sensor 308R, respectively.

In S905, the control unit 400 determines whether the slitter origin sensor 308L has detected the slitter flag 303*f*L, which is attached to the slitter unit 303L. Similarly, the control unit 400 determines whether the slitter origin sensor 308R has detected the slitter flag 303*f*R, which is attached to the slitter unit 303R. It is indicated that the slitter origin sensor 308L in FIG. 8 is in a state of having detected the slitter flag 303*f*L. Furthermore, it is indicated that the slitter origin sensor 308R is in a state of having detected the slitter flag 303*f*R.

In a case where it is determined that the slitter origin sensor 308L has detected the carriage flag 3*f*L, the control unit 400 stops the movement of the slitter unit 303L and resets the value of the moving distance StL of the slitter unit 303L to "0" in S906. Similarly, in a case where it is determined that the slitter origin sensor 308R has detected the carriage flag 3*f*R, the control unit 400 stops the slitter unit 303R and resets the value of the moving distance StR of the slitter unit 303R to "0" in S906. The order of the processes of S901 through S903 and the processes of S904 through S906 may be reversed or both of the processes may be performed simultaneously.

Figure 10:
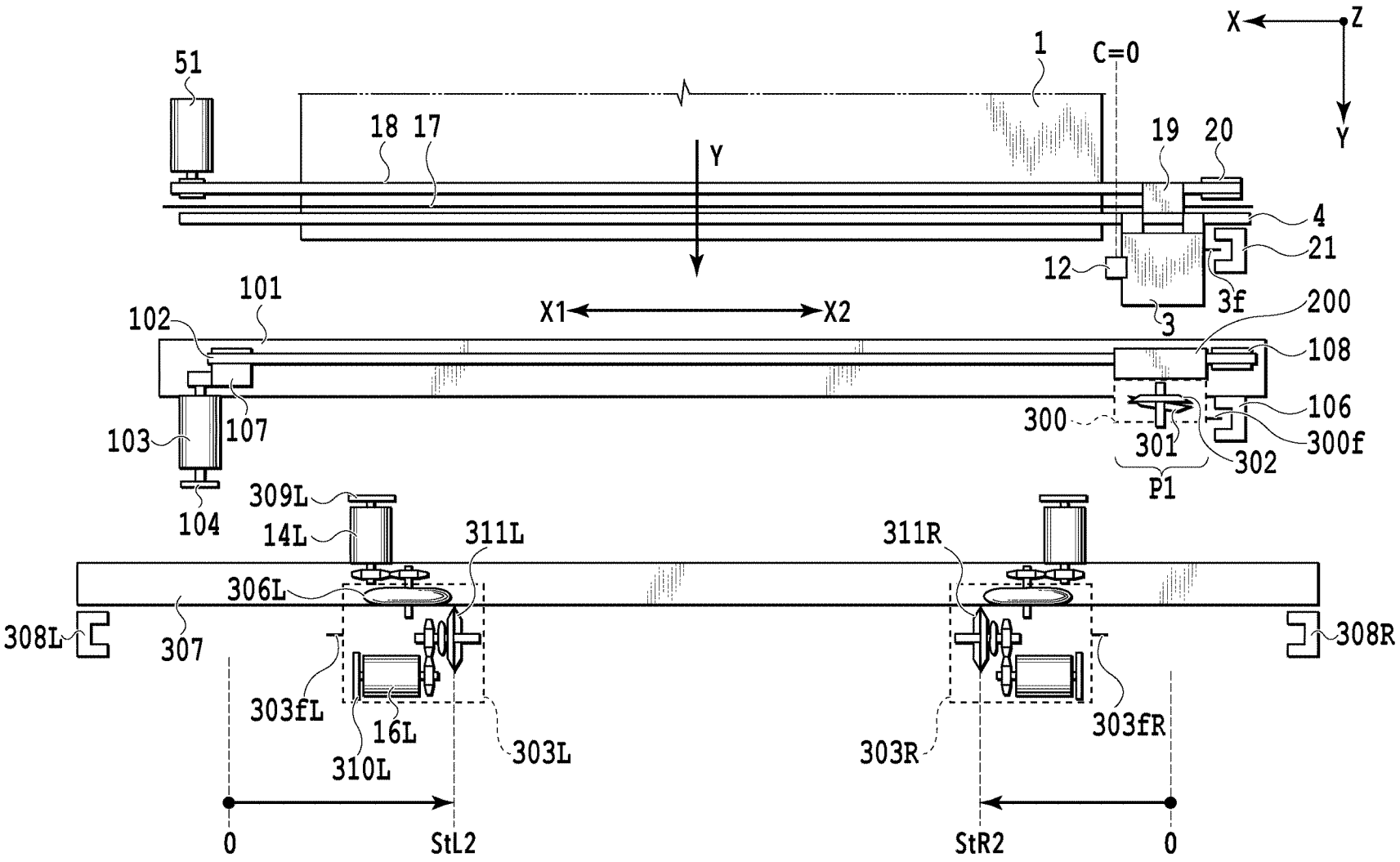
FIG. 10 is a diagram for explaining an operation for correcting moving distances of the carriage, which are to be references.

In S907, the control unit 400 moves the slitter units 303L and 303R to given locations in the range of the roll sheet 1 in the intersecting direction, as illustrated in FIG. 10. It is assumed that, at that timing, the value of the moving distance StL of the slitter unit 303L is StL2 and the value of the moving distance StR of the slitter unit 303R is StR2.

In S908, the control unit 400 stores StL2, which is the value of the moving distance of the slitter unit 303L, and StR2, which is the value of the moving distance of the slitter unit 303R, in the ROM 412.

Figure 11:
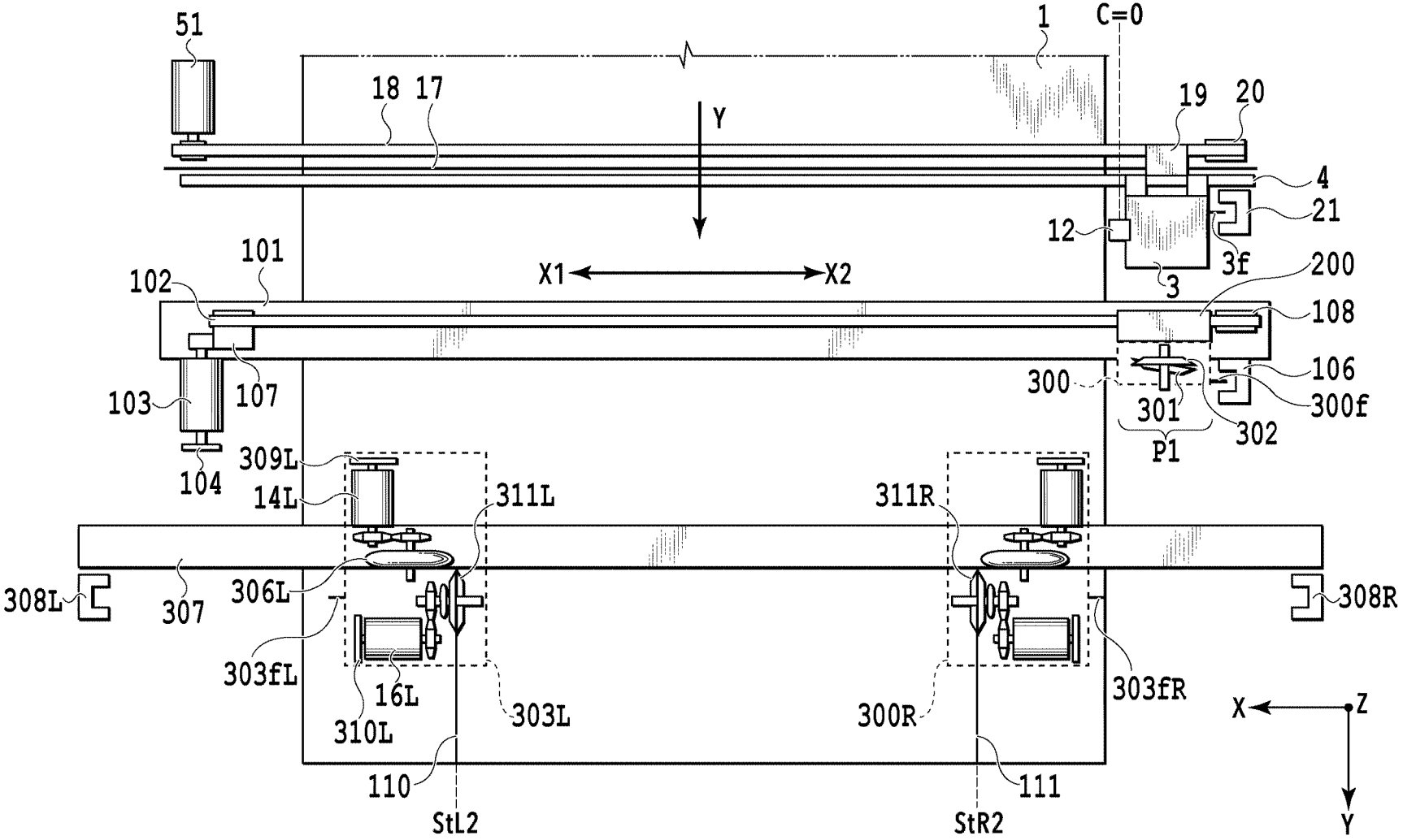
FIG. 11 is a diagram for explaining the operation for correcting moving distances of the carriage, which are to be references.

In S909, the control unit 400 drives the slitter driving motors 16 mounted on the respective slitter units 303, so as to rotate the slitter upper movable blades 304 and the slitter lower movable blades 305, respectively. Furthermore, the control unit 400 rotates the conveyance roller 8, so as to convey the roll sheet 1 in the conveyance direction Y. As illustrated in FIG. 11, in a case where the roll sheet 1 is conveyed and reaches each of the slitter units 303, the roll sheet 1 is cut by the slitter units 303. The cut portion that is made by the slitter unit 303L is a slit L 110, and the cut portion that is made by the slitter unit 303R is a slit R 111.

In S910, the control unit 400 stops the conveyance roller 8 and each of the slitter driving motors 16 after conveying the roll sheet 1 by a predetermined amount.

Figure 12:
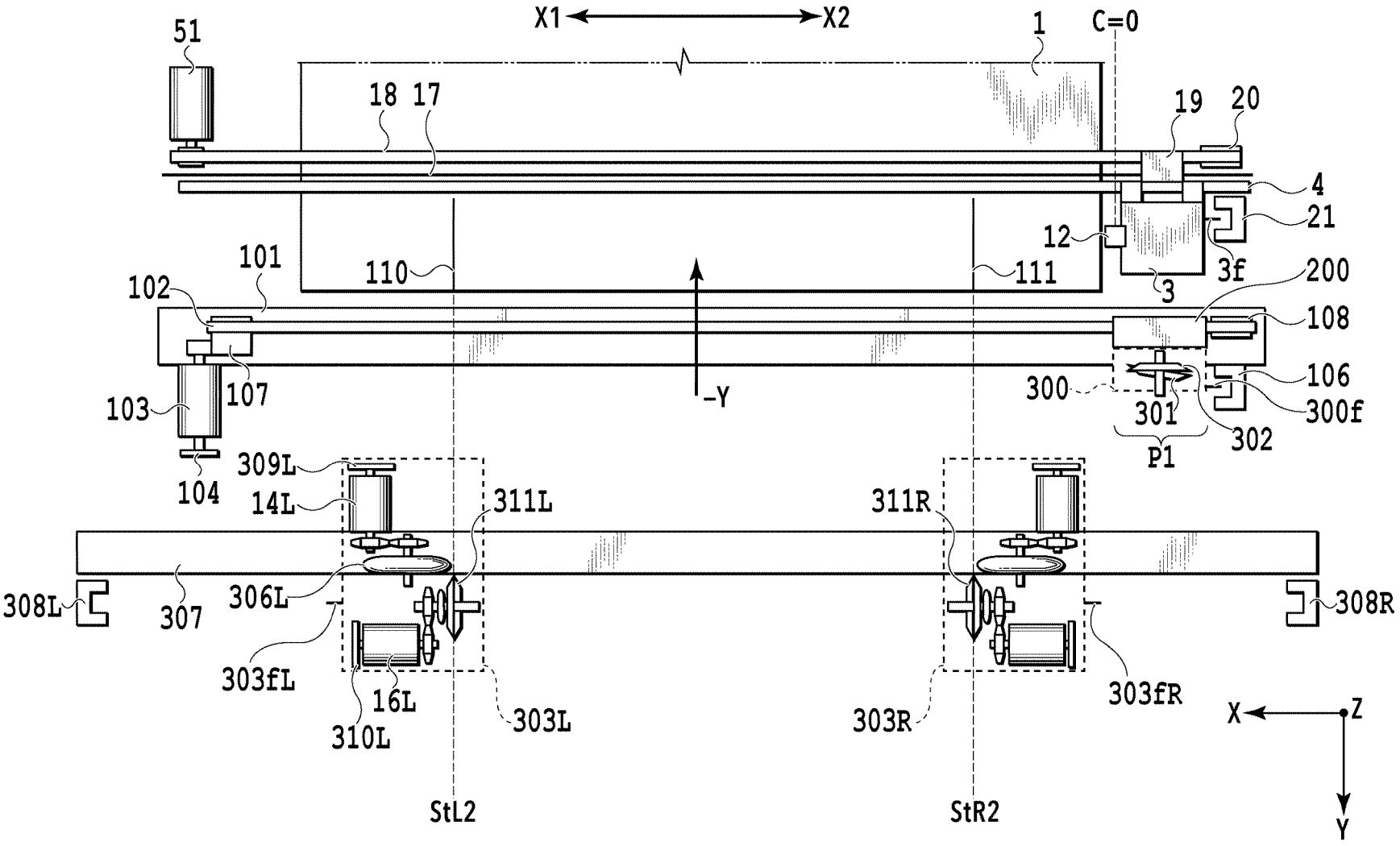
FIG. 12 is a diagram for explaining the operation for correcting moving distances of the carriage, which are to be references.

In S911, the control unit 400 rotates the conveyance roller 8 in the opposite direction, so as to convey the roll sheet 1 in the opposite direction (−Y direction) of the conveyance direction Y. In S912, the control unit 400 stops the conveyance roller 8 in a case where the roll sheet 1 is conveyed up to the position where the slit L 110 and the slit R 111 are positioned in the X1 direction of the detection sensor 12, which is mounted on the carriage 3, as illustrated in FIG. 12.

Figure 13:
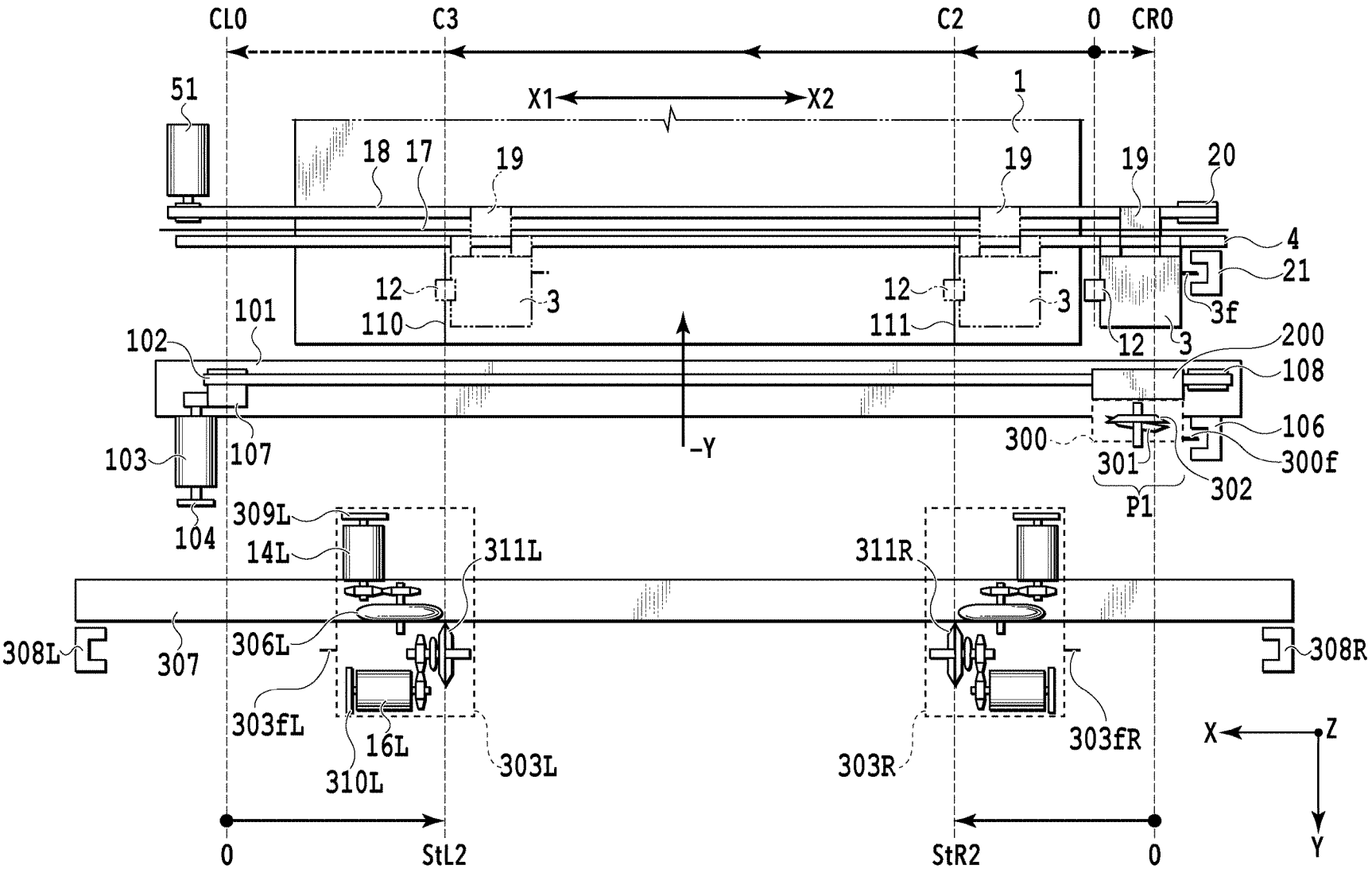
FIG. 13 is a diagram for explaining the operation for correcting moving distances of the carriage, which are to be references.

In S913, the control unit 400 moves the carriage 3 in the X1 direction with the detection sensor 12 being in a detectable state, as illustrated in FIG. 13. The control unit 400 detects the slit L 110 and the slit R 111 by detecting the reflectivity of the roll sheet 1 by use of the detection sensor 12, so as to determine the values of the moving distances C of the carriage 3 at the timing where the slits are detected.

Figure 14:
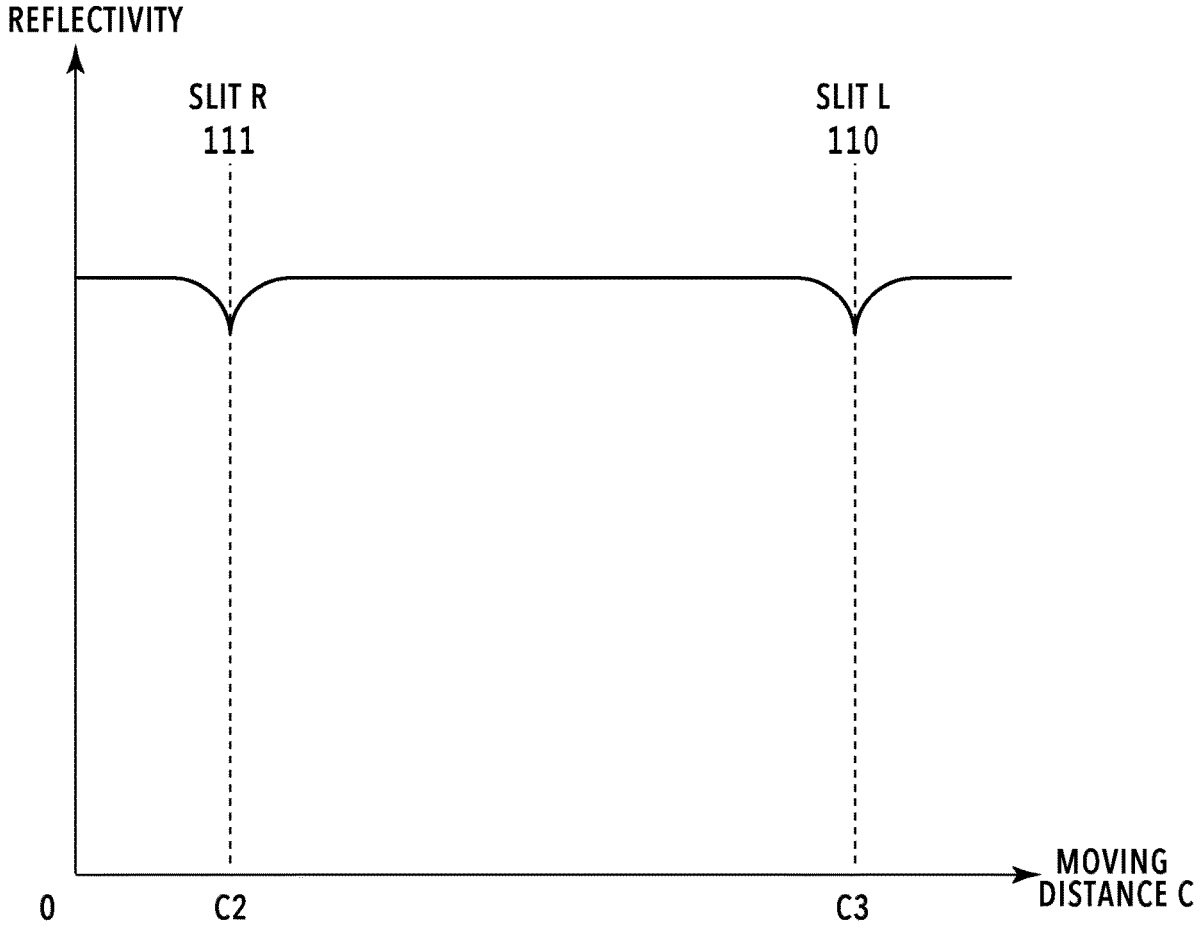
FIG. 14 is a graph representing a relationship between reflectivity for a detection sensor and a moving distance of the carriage.

FIG. 14 is a diagram illustrating the relationship between the moving distance C of the carriage 3 and the reflectivity detected by the detection sensor 12. The horizontal axis in FIG. 14 indicates the values of the moving distance C of the carriage, and the vertical axis indicates the reflectivity detected by the detection sensor 12. Because of the platen 10, which has small reflectivity, the reflectivity is detected to be low at the slit L 110 and the slit R 111 of the roll sheet 1. The control unit 400 determines the values of the moving distances C of the carriage at the timings where the reflectivity becomes low as C2 and C3, respectively, from the one closer to the origin of the carriage 3. C2 is the value of the moving distance C of the carriage at the timing where the slit R 111 is detected. C3 is the value of the moving distance C of the carriage at the timing where the slit L 110 is detected.

In S914, the control unit 400 stores C2 and C3, which are the values of the moving distances C up to the respective slits, in the ROM 412.

In S915, the control unit 400 determines the values of the moving distances C of the carriage 3 corresponding to the origin positions of the slitter units 303. It is assumed that CL0 is the value of the moving distance C that is required for the carriage 3 to move to the position that is on the upstream (−Y direction) of the origin "StL=0" of the slitter unit 303L in the conveyance direction. Similarly, it is assumed that CR0 is the value of the moving distance C that is required for the carriage 3 to move to the upstream position of the origin "StR=0" of the slitter unit 303R. In other words, CR0 is a predetermined moving distance that is required for the carriage 3 to move from the origin position of the carriage 3 to the position in the intersecting direction (X direction) corresponding to the origin position of the slitter unit 303R. Furthermore, CL0 is a predetermined moving distance that is required for the carriage 3 to move from the origin position of the carriage 3 to the position in the intersecting direction (X direction) corresponding to the origin position of the slitter unit 303L. CR0 and CL0 need not be moving distances for the carriage 3 to be actually movable.

CL0 is determined by subtracting StL2, which is the value of the moving distance of the slitter unit 303L for forming the slit L 110, from C3, which is the value of the moving distance C of the carriage at the timing where the slit L 110 is detected. Similarly, CR0 is determined by subtracting StR2, which is the value of the moving distance of the slitter unit 303R for forming the slit R 111, from C2, which is the value of the moving distance C of the carriage 3 at the timing where the slit R 111 is detected. The calculation formula is as follows.

$$CL0=C3-StL2$$

$$CR0=C2-StR2$$

Figure 15:
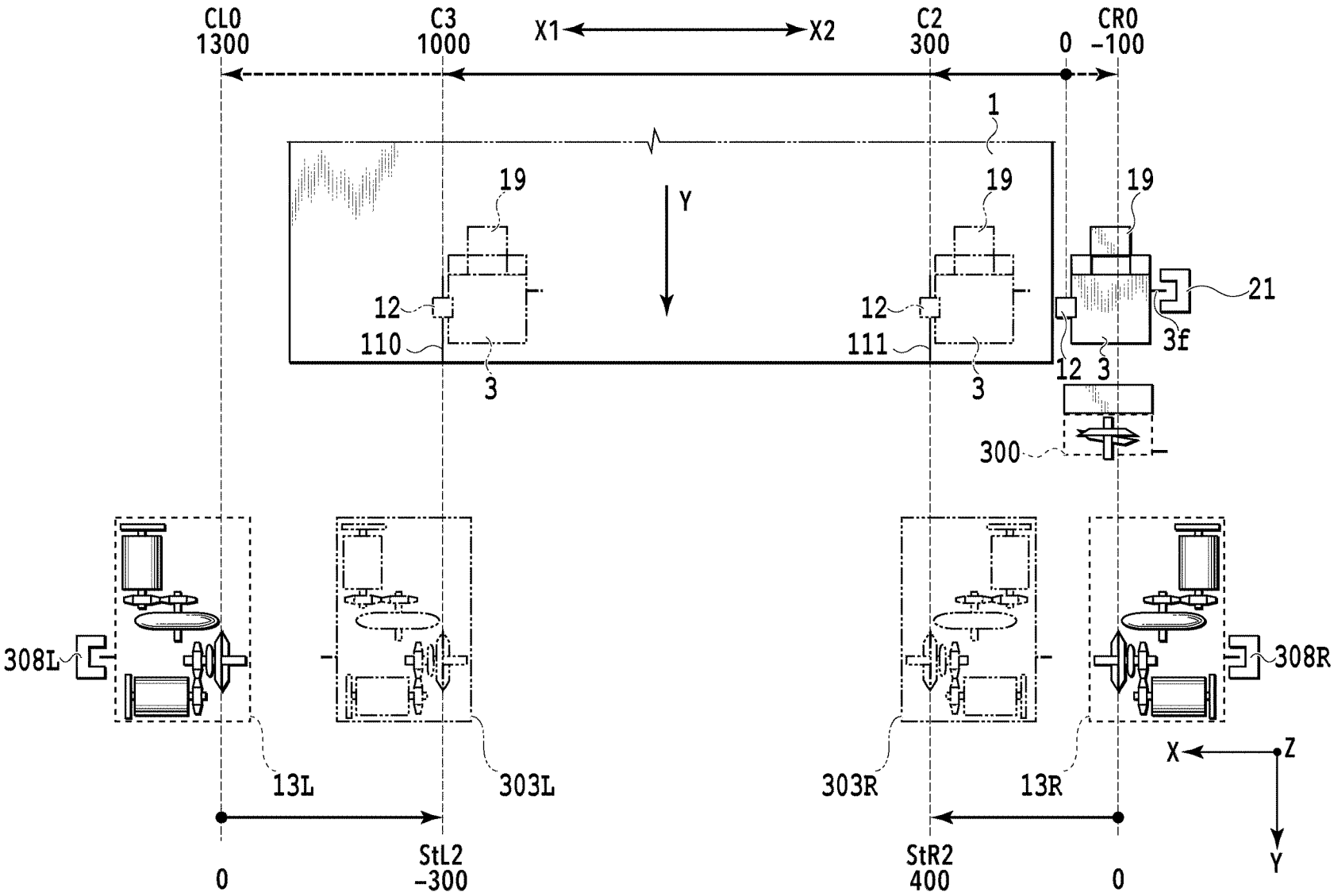
FIG. 15 is a diagram for explaining the operation for correcting moving distances of the carriage, which are to be references.

Here is an explanation based on specific numerical examples with reference to FIG. 15. In FIG. 15, some members are omitted for the sake of explanation. The slitter unit 303L performs cutting at the position where the value of the moving distance is −300 (that is, "StL2=−300"), and the slitter unit 303R performs cutting at the position where the value of the moving distance is 400 (that is, "StR2=400"). Regarding the values of the moving distances of the carriage 3 for detecting the slits of the respective slitter units 303, it is assumed that C2 is 300 and C3 is 1000, respectively. In this case, CL0 and CR0 are obtained as follows.

$$CL0=1000-(-300)=1300$$

$$CR0=300-400=-100$$

As explained with reference to FIG. 6, the values of CL0 and CR0 are moving distances for determining the moving distance StL or StR of the slitter corresponding to a given moving distance C of the carriage.

In S916, the control unit 400 stores the respective values of CL0 and CR0 in the ROM 412.

In S917, the control unit 400 moves the slitter units 303L and 303R to the respective origin positions. In S918, the control unit 400 conveys the roll sheet 1 in the conveyance direction Y according to the length of the slit L 110 and the slit R 111. In S919, the control unit 400 cuts the roll sheet 1 in the X direction by use of the cutter 5, so as to separate the area of the roll sheet 1 including the slit L 110 and the slit R 111.

The above is the flow for correcting controlled moving distances of the carriage 3 corresponding to the origin positions of the slitter units 303. According to the processing of the present flow, even in such a case where a moving distance designed for the carriage 3 to move to the position corresponding to the origin position of a slitter unit 303 is different from the actual moving distance as described in the comparative example, it is possible to correct the moving distance that is set in the printing apparatus into the actual moving distance. Furthermore, it is possible to obtain the moving distance StL or StR that corresponds to a given moving distance C of the carriage in such a manner as explained with reference to FIG. 6, based on CL0 and CR0 which are the corrected moving distances for the carriage 3 to move to the positions corresponding to the origin positions of the slitter units 303.

Additionally, since the print head 2 is mounted on the carriage 3, the accuracy of the distance Hb between the print head 2 and the detection sensor 12, which is the reference of the position of the carriage 3, is guaranteed by preliminary printing adjustment, or the like. Therefore, it is possible to obtain the moving distance StL or StR of the slitter corresponding to the position of the print head 2 in the X direction, based on the corrected moving distances for the carriage 3 to move to the positions corresponding to the origin positions of the slitter units 303. Therefore, the slitter can be moved in accordance with the printed image as described later.

The flow of FIG. 9 may be executed at a given timing based on an instruction by a user or may be executed in a case where a predetermined condition is satisfied. For example, the flow of FIG. 9 may be performed in a case where a predetermined period has elapsed since the last correction. Alternatively, there may be a form in which the above-described flow is performed at a timing where the electric power source is turned on after the printing apparatus 100 is delivered. Further, the flow of FIG. 9 may be performed at a timing after replacement of the slitter units 303 or the carriage 3.

Furthermore, there may be a form provided with a manual mode in which the values of CL0 and CR0 can be obtained and updated by a user at a given timing through the flow of FIG. 9. Alternatively, there may be a form provided with an automatic mode in which the values of CL0 and CR0 can be obtained and updated through the flow of FIG. 9 in a case where a predetermined condition is satisfied. There may be a form in which the manual mode and the automatic mode are switchable.

[Control of Movement of the Slitter]

Figure 16:
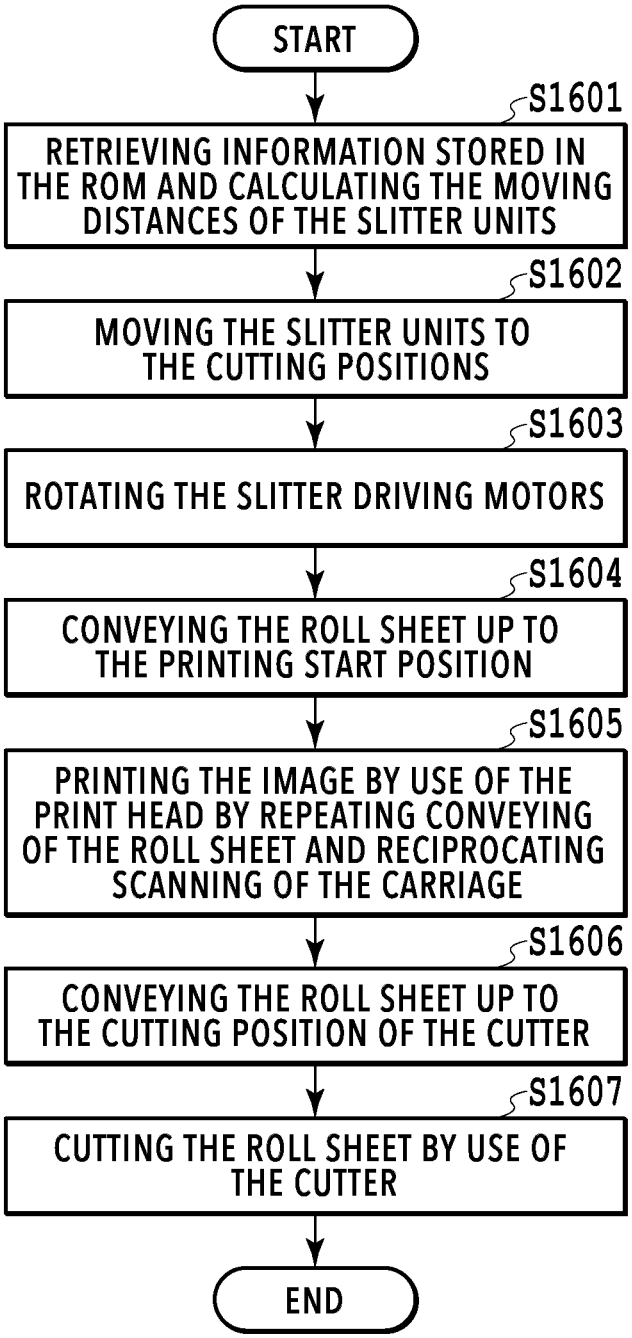
FIG. 16 is a flowchart of processing in which the slitter moves in accordance with the positions of the carriage.

FIG. 16 is a flowchart illustrating a series of processes for controlling the cutting positions of the slitter units 303 in accordance with a printed image, based on the moving distances of the carriage 3 corresponding to the origin positions of the slitter units 303. Moreover, FIG. 17 is a diagram similar to the top view of FIG. 2 and is a diagram in which some parts are omitted for the purpose of explaining the processes in the present flowchart.

Figure 17:
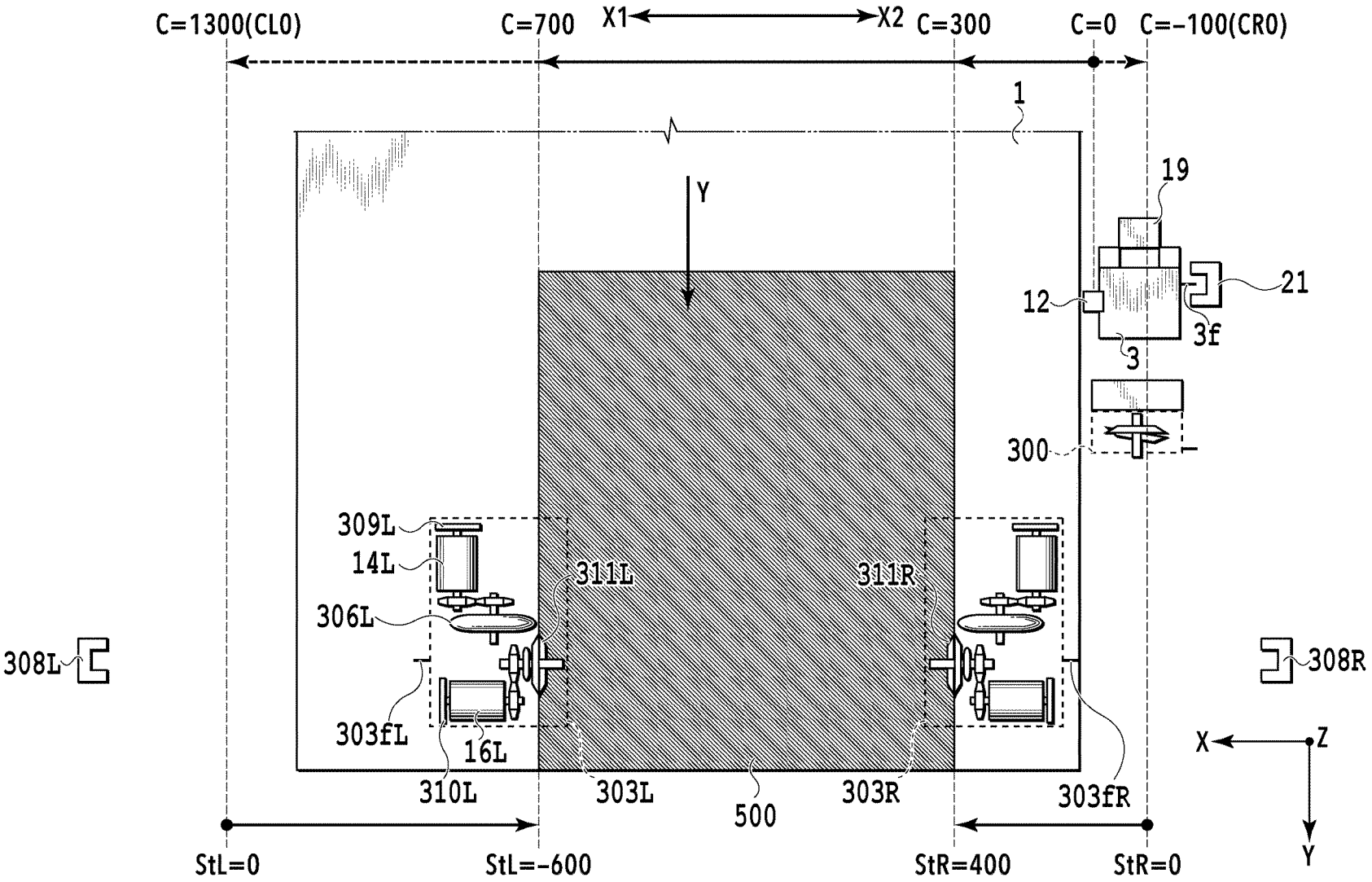
FIG. 17 is a diagram for explaining how the slitter moves in accordance with the positions of the carriage.

As illustrated in FIG. 17, regarding the size of the printed image 500, it is assumed that the right end of the printed image 500 corresponds to the position of the carriage 3 in a case where the carriage 3 is moved such that the moving distance C becomes 300. Furthermore, it is assumed that the left end of the printed image corresponds to the position of the carriage 3 in a case where the carriage 3 is moved such that the moving distance C becomes 700. The moving distances C of the carriage in accordance with the size of the printed image 500 can be determined in consideration of the positions of the print head 2 and the detection sensor 12. That is, the position of the print head 2 for printing an image and the position of the detection sensor 12, which is the reference of the position of the carriage 3, are away from each other by the distance Hb, as illustrated in FIG. 8. Therefore, it is possible to obtain the moving distances C of the carriage in accordance with the size of the printed image 500, based on the moving distances obtained by adjusting the moving distances of the movement of the carriage for printing the printed image 500 by use of the moving distance corresponding to the distance Hb. Alternatively, it is possible to determine end portions of the printed image 500 by use of the detection sensor 12, so as to determine the moving distances C of the carriage in accordance with the size of the width of the printed image 500.

In the present flowchart, an explanation is given with the example of a case in which the left end and the right end of the printed image 500 are cut by the slitter units 303, so as to generate a borderless printed subject. Therefore, in the present flowchart, each of the moving distances StL and StR of the slitter, which correspond to the moving distances C of the carriage that indicate the end portions of the printed image 500 in the intersecting direction, is obtained. Then, an explanation is given of a series of processes in which the slitter units 303 are moved by the obtained moving distances, so that the left end and the right end of the printed image 500 are cut by the slitter units 303.

In S1601, the control unit 400 determines the cutting positions of the slitter units 303L and 303R, that is, the moving distances StL and StR, which are up to the left and right ends of the printed image 500. The moving distance StL, which is for moving the slitter unit 303L to the position corresponding to the position of the carriage 3 that is moved by the moving distance C, is determined by subtracting CL0 from the moving distance C of the carriage 3. Here, CL0 is the value of the moving distance C of the carriage 3 corresponding to the origin position of the slitter unit 303L. Similarly, the moving distance StR of the slitter corresponding to a moving distance C of the carriage is determined by subtracting CR0 from the moving distance C of the carriage. Here, CR0 is the value of the moving distance C of the carriage corresponding to the origin position of the slitter. The calculation formula is as follows.

$$StL=C-CL0$$

$$StR=C-CR0$$

That is, based on CL0 or CR0, it is possible to obtain the moving distance StL or StR of the slitter corresponding to a given moving distance C of the carriage. CL0 and CR0 used here are numerical values obtained by the processes in the flowchart of FIG. 9 and stored in the ROM. In the explanation of the present flowchart, it is assumed that CL0 is recorded as 1300 and CR0 is recorded as −100 in the ROM. The specific calculation results of the moving distances StL and StR for moving the slitter units 303 to the left and right ends of the printed image 500 are as follows.

$$StL=700-1300=-600$$

$$StR=300-(-100)=400$$

In S1602, the control unit 400 moves the slitter units 303L and 303R, based on the calculated moving distances StL and StR.

In S1603, the control unit 400 drives the slitter driving motors 16 mounted on the respective slitter units 303L and 303R, so as to rotate the respective slitter upper movable blades 304 and slitter lower movable blades 305.

In S1604, the control unit 400 rotates the conveyance roller 8 to convey the roll sheet 1 in the conveyance direction Y up to the printing start position.

In S1605, the control unit 400 makes the print head 2 print the printed image 500 by repeating conveying of the roll sheet 1 and scanning of the carriage 3. In a case where the roll sheet 1 reaches the slitter units 303, as illustrated in FIG. 17, the slitter unit 303L starts cutting the left end of the printed image 500, and the slitter unit 303R starts cutting the right end of the printed image 500.

In S1606, upon completion of the printing of the printed image 500, the control unit 400 further conveys the roll sheet 1 up to the cutting position of the cutter 5. Since the printed subject generated in the present example is a borderless image, the position to be cut by the cutter 5 is the end portion of the printed image 500 on the upstream side in the conveyance direction.

In S1607, the control unit 400 makes the cutter 5 cut the end portion of the printed image 500, which is on the upstream side in the conveyance direction, and the present flow ends.

As explained above, according to the present embodiment, it is possible to move a slitter unit 303 to a desired position with reference to the position of the carriage 3 even in such a case where the printing apparatus is deteriorated by aging or such a case where a movable blade of the slitter is replaced. Since the print head is mounted on the carriage, it is possible to move the slitter to a desired position with reference to the position of the print head. Therefore, according to the present embodiment, it is possible to move a slitter unit 303 for cutting in accordance with the size of a printed image that is printed by the print head 2 as illustrated in FIG. 17.

Although the explanation of the present embodiment has been given with the example in which there are two slitter units on the left and right, the correction may be similarly performed even in a case where there is one slitter unit.

Furthermore, in the present embodiment, the method of adjusting the slitter units 303 to a printed image is described. Similarly, it is also possible to move the carriage 3 to desired positions with reference to the positions of the slitter units 303. Therefore, it is possible to adjust the position of a printed image to be printed by the print head 2 to the position to be cut by the slitter units 303.

Figure 18A:
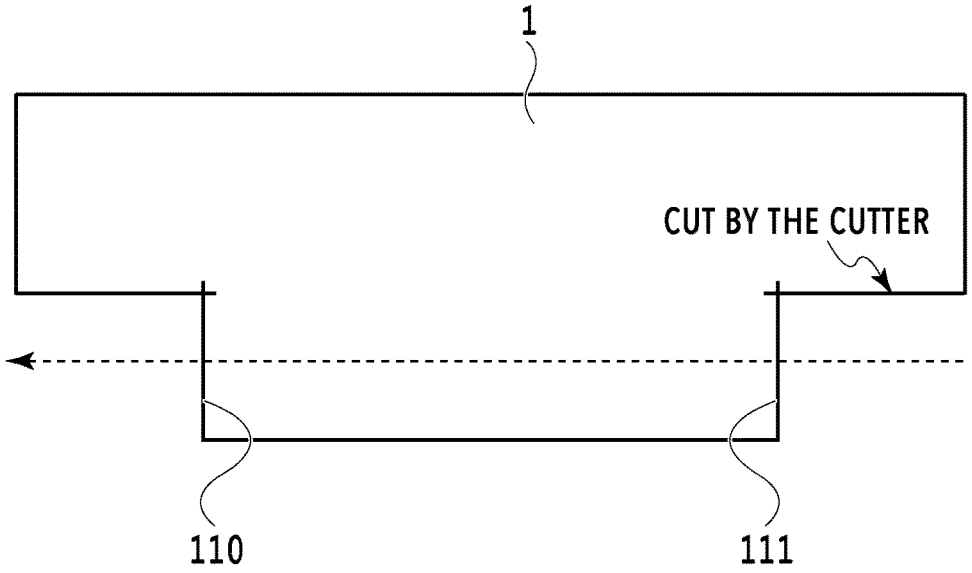
FIG. 18A is a diagram for explaining a roll sheet that is cut by a cutter and the slitter.

Furthermore, the method of detecting the cut portions that are made by the slitter units 303 may be another method. For example, the roll sheet 1 having the slits, which are cut in by the slitter units 303, is cut by the cutter 5 in the X direction up to the slits made by the slitter units 303. FIG. 18A is a diagram illustrating an example of the roll sheet 1 that is cut by the cutter 5 in the X direction from the right end of the roll sheet 1 up to the slit R 111 and cut in the X direction from the left end of the roll sheet 1 up to the slit L 110. For such a roll sheet 1, the method in which the detection sensor 12 detects the cut portions that are made by the slitter units 303 may be used.

Figure 18B:
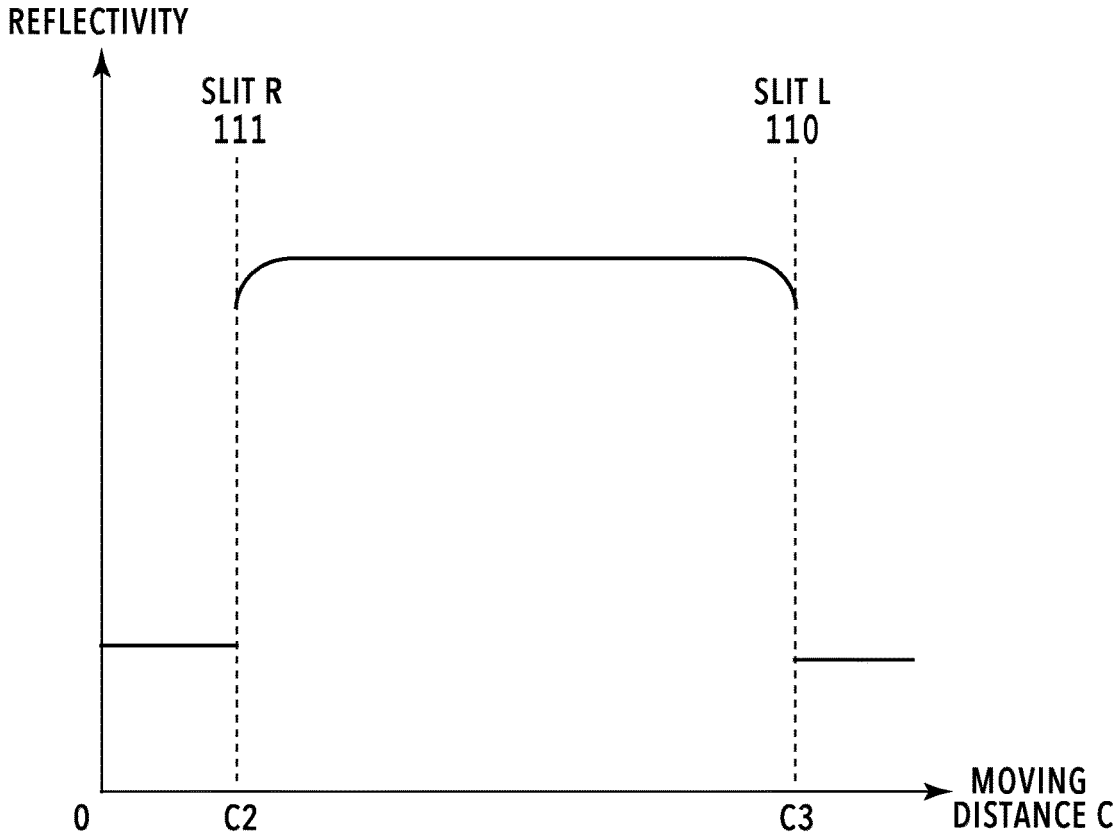
FIG. 18B is a diagram for explaining the roll sheet that is cut by the cutter and the slitter.

FIG. 18B is a graph similar to FIG. 14 and is a graph illustrating the relationship between the moving distance C of the carriage 3 and the reflectivity in a case where the detection sensor 12 detects the reflectivity while the carriage 3 moves on the dotted line of the roll sheet 1 in FIG. 18A. In this example, as illustrated in FIG. 18A, the slit L 110 and the slit R 111 are the end portions of the roll sheet 1. Therefore, since the change in reflectivity is clear at the boundaries of the slits, the cut portions that are made by the slitter units 303 can be clearly detected, compared to a slit L 110 or a slit R 111 that is not cut by the cutter 5.

Second Embodiment

In the present embodiment, an explanation is given of a form in which the moving distance of the carriage corresponding to the origin position of a slitter unit is corrected by directly detecting the position of the slitter unit by use of a detection sensor mounted on the carriage.

Figure 19:
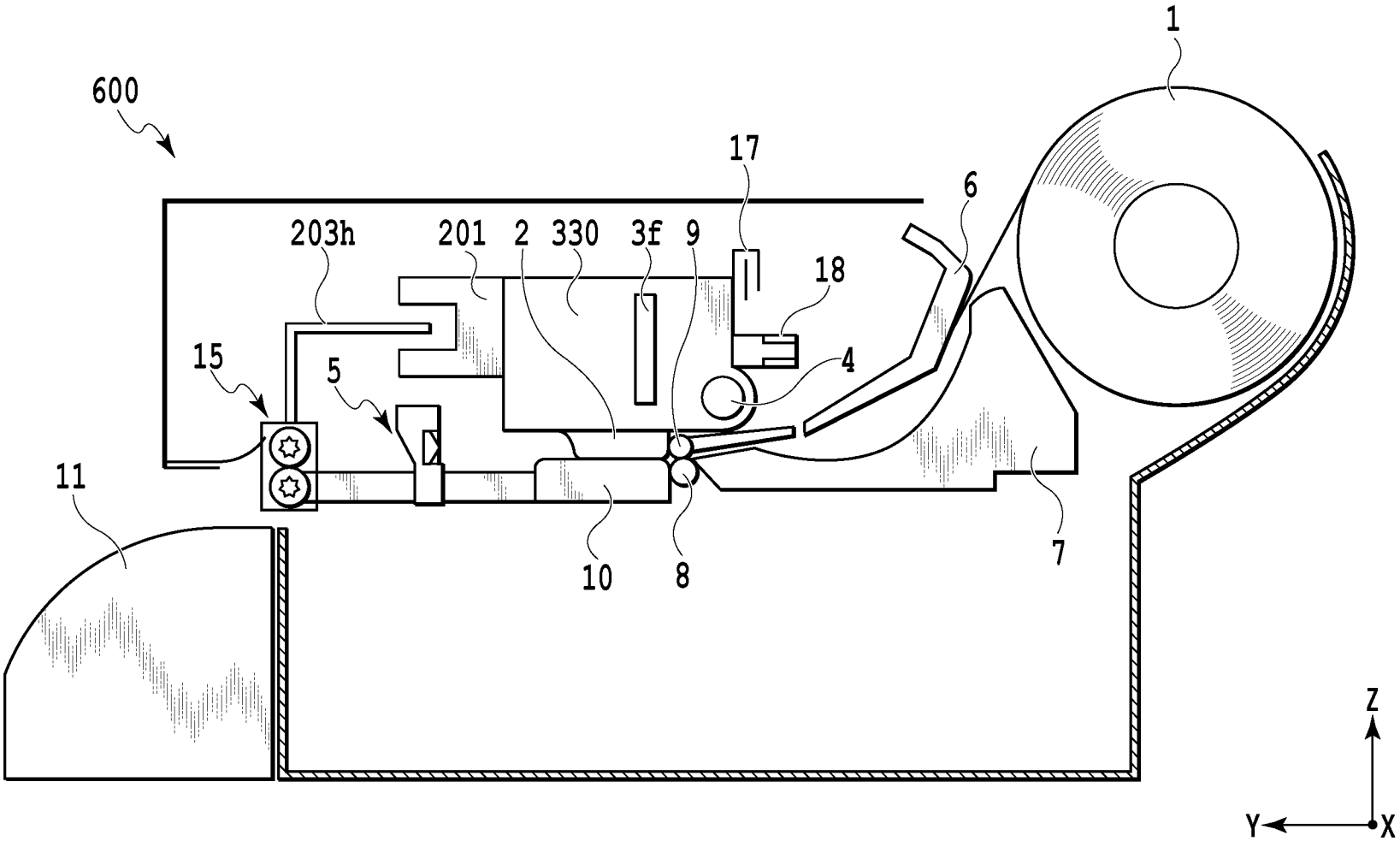
FIG. 19 is a cross-sectional view of a printing apparatus.

FIG. 19 is a cross-sectional view illustrating an example of an inkjet printing apparatus 600 (hereinafter referred to as the printing apparatus 600) according to the present embodiment. The same members as in the first embodiment are assigned with the same numerals to omit explanations thereof. In the printing apparatus 600 of the present embodiment, the slitter unit 314 of the slitter 15 is provided with the slitter detection flag 203*h* as a position detection member. Furthermore, the detection sensor 201 is disposed on the carriage 330 on the downstream side in the conveyance direction. The detection sensor 201 has a concave portion and is configured to detect the slitter detection flag 203*h* in a case where an end portion of the slitter detection flag 203*h* is housed in the concave portion. Although, in the present embodiment, an explanation is given of the case in which there is one slitter unit, there may be multiple slitter units. For example, as explained in the first embodiment, there may be a form in which two slitter units are included.

Figure 20:
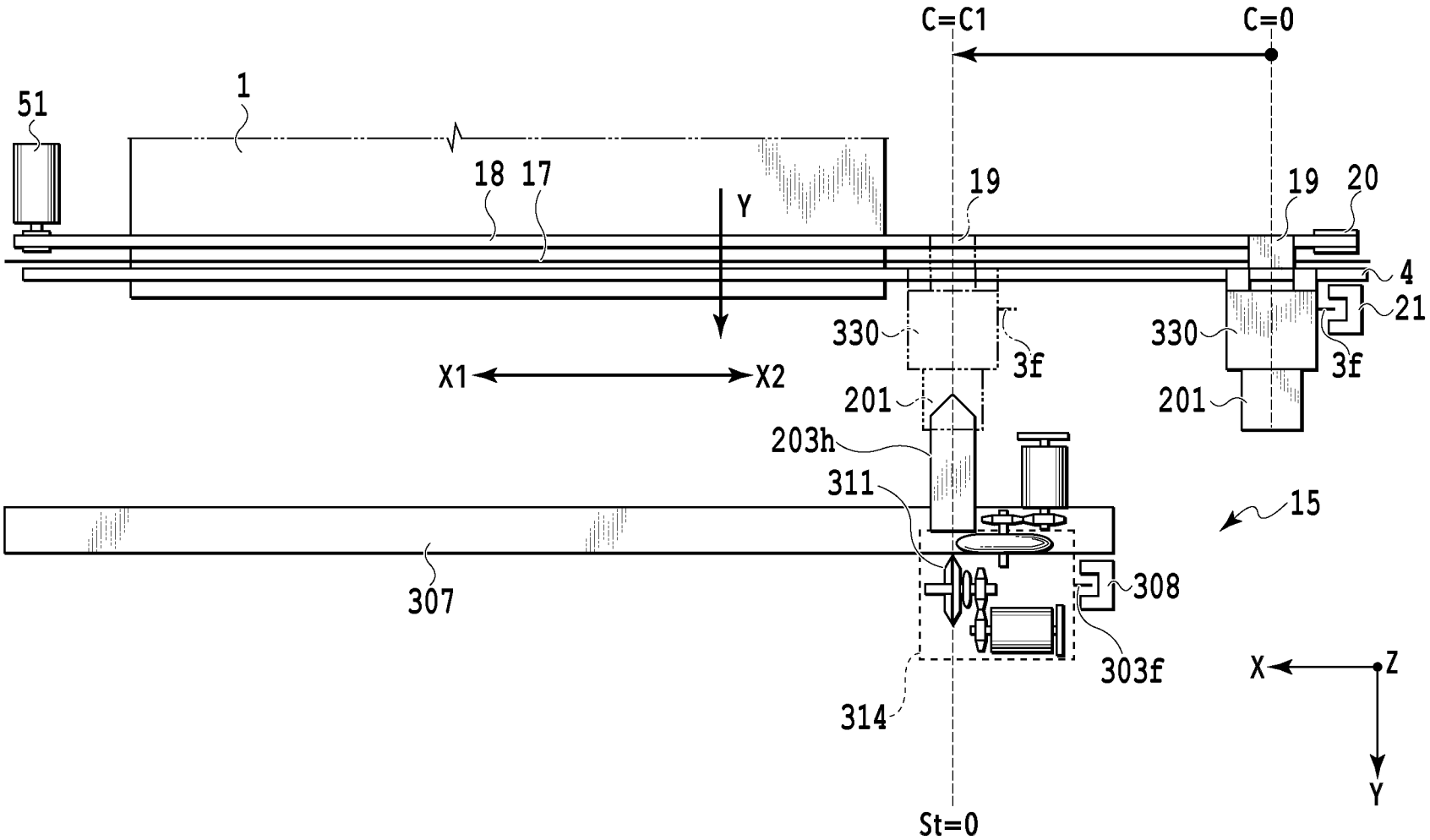
FIG. 20 is a top view of the printing apparatus for explaining a carriage and a slitter.

FIG. 20 is a top view of the printing apparatus 600, in which some parts, such as the cutter 5, are omitted. In FIG. 20, the carriage 330 represented by a two-dot chain line indicates that the carriage 330 has moved from the origin position in the X1 direction and the detection sensor 201 of the carriage 330 has detected the slitter detection flag 203*h*.

Figure 21:
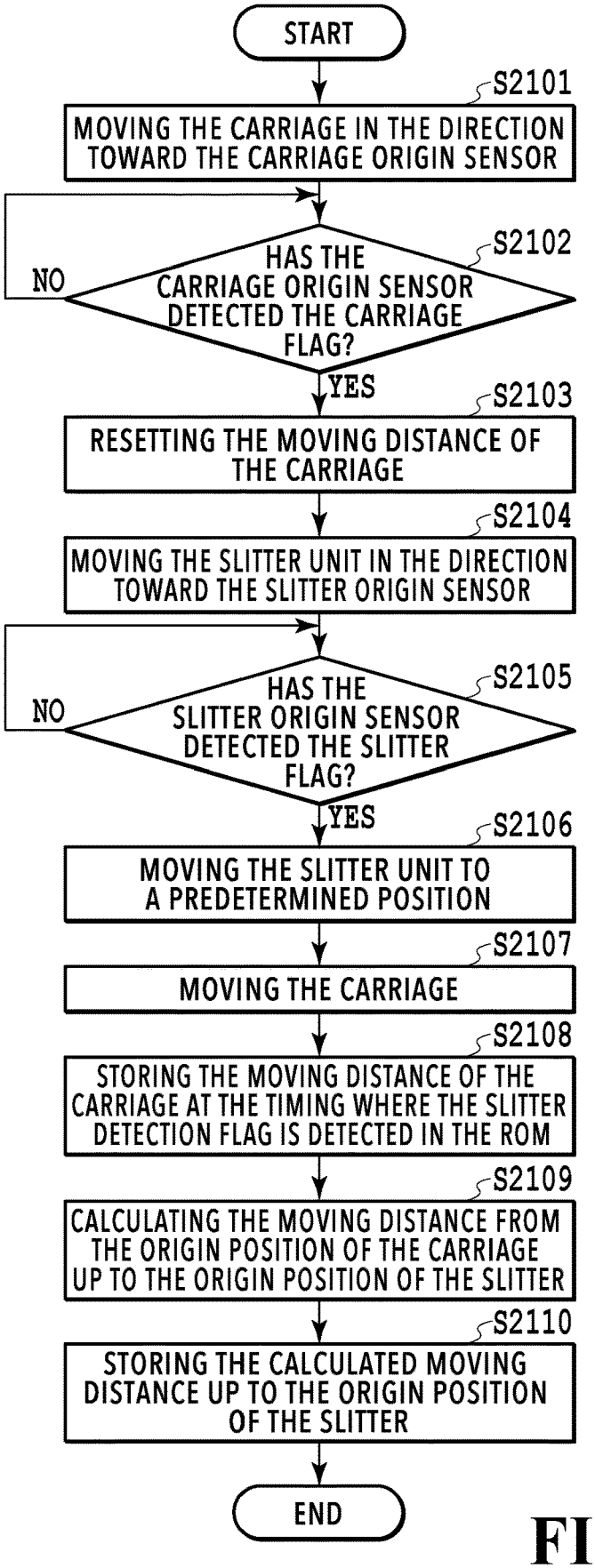
FIG. 21 is a flowchart of processing for correcting a moving distance of the carriage, which is to be a reference.

FIG. 21 is a flowchart for explaining the contents of the processing in the present embodiment, which is for correcting the value of the moving distance by which the carriage 330 moves to the position corresponding to the origin position of the slitter unit 314. In the present embodiment, the moving distance of the slitter unit 314 is represented as the moving distance St, and the moving distance of the carriage 330 is represented as the moving distance C. In the present embodiment, the position of the detection sensor 201 corresponds to the position on the carriage 3.

The processes of S2101 through S2005 are processes for updating the positions to be the origins ("C=0", "St=0") of the respective moving distances of the carriage 330 and the slitter unit 314, which are the same processes as S901 through S905. Therefore, the explanations thereof are omitted.

In S2106, the control unit 400 moves the slitter unit 314 to a given position in the X1 direction. The value of the moving distance St of the slitter unit 314 at that timing is defined as St1. In a case where the carriage 330 is movable to the origin position of the slitter unit 314 as illustrated in FIG. 20, the slitter unit 314 need not be moved from the origin position. In this case, this step is unnecessary.

In S2107, the control unit 400 moves the carriage 330 in the X direction until the detection sensor 201 detects the slitter detection flag 203*h*. The value of the moving distance C of the carriage 330 at the timing where the detection sensor 201 detects the slitter detection flag 203*h* is defined as C1. In S2108, the control unit 400 stores C1 in the ROM 412.

In S2109, the control unit 400 determines C0, which is the value of the moving distance C for the carriage 330 to be positioned on the upstream of the origin "St=0" of the slitter unit 303 in the conveyance direction. In other words, C0 is a predetermined moving distance that is required for the carriage 330 to move from the origin position of the carriage 330 to the position in the intersecting direction (X direction) corresponding to the origin position of the slitter unit 314.

C0 is determined by subtracting St1, which is the value of the moving distance St by which the slitter unit 314 is moved in S2106, from C1, which is the value of the moving distance C of the carriage 330 at the timing where the slitter detection flag 203*h* is detected. The calculation formula is as follows.

$$C0=C1-St1$$

As illustrated in FIG. 20, in a case where the slitter unit 314 is not moved in S2106, St1, which is the value of the moving distance St of the slitter unit 314, is 0. Therefore, C0 is obtained by the following formula.

$$C0=C1$$

In S2110, control unit 400 stores C0 in ROM 412, and the present flow ends.

According to the present flow, it is possible to determine C0, which is the value of the moving distance C of the carriage corresponding to the origin position "St=0" of the slitter unit 314. Therefore, as with the first embodiment, the moving distance St of the slitter unit 314 corresponding to a moving distance C of the carriage is determined by subtracting C0 from the moving distance C of the carriage. Here, C0 is the value of the moving distance C of the carriage corresponding to the origin position of the slitter. The calculation formula is as follows.

$$St=C-C0$$

As explained above, according to the present embodiment, it is possible to move a slitter unit to a desired position with reference to the position of a carriage even in such a case where the printing apparatus is deteriorated by aging or such a case where a movable blade of the slitter is replaced. Since the print head is mounted on the carriage, it is possible to move the slitter unit to a desired position with reference to the position of the print head. Therefore, according to the present embodiment, it is possible to move the slitter unit for cutting in accordance with the size of a printed image that is printed by the print head.

Furthermore, in such a form where the slitter detection flag 203*h* can be detected by the detection sensor 201 even though the slitter unit 314 is at the origin position as illustrated in FIG. 20, the slitter unit 314 need not be moved. Therefore, in the present embodiment, it is possible to reduce the time period used for determining the moving distance of the carriage corresponding to the origin position of the slitter unit 314, compared to the first embodiment. Furthermore, in the present embodiment, it is possible to perform the processing of determining the moving distance of the carriage corresponding to the origin position of the slitter unit 314 even without a printing medium such as the roll sheet 1.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-67048 filed Mar. 29, 2019, which is hereby incorporated by reference wherein in its entirety.

What is claimed is:

1. A printing apparatus comprising:

a conveyance unit configured to convey a printing medium in a conveyance direction;

a printing unit configured to print an image on the printing medium;

a carriage having the printing unit and configured to be movable in an intersecting direction, which intersects the conveyance direction; and a slitter configured to be movable in the intersecting direction and cut the printing medium in the conveyance direction, wherein the printing apparatus includes a detection unit, which is mounted on the carriage and configured to be able to detect a cut portion of the printing medium that has been cut by the slitter, wherein, after the slitter is controlled to move and cut the printing medium, the carriage is controlled to move, so that the cut portion is detected by the detection unit, and wherein the printing apparatus includes a control unit configured to control a moving distance of the carriage or the slitter, based on a first moving distance and a second moving distance, the first moving distance indicating a moving distance of the carriage at a timing where the detection unit detects the cut portion, the second moving distance indicating a moving distance of the slitter moved to cut the printing medium.

2. The printing apparatus according to claim 1, wherein, after the slitter cuts the printing medium, the conveyance unit conveys the printing medium up to a position where the detection unit is able to detect the cut portion.

3. The printing apparatus according to claim 1, wherein the detection unit detects the cut portion, based on reflectivity.

4. The printing apparatus according to claim 1 further comprising a cutter configured to cut the printing medium in the intersecting direction.

5. The printing apparatus according to claim 4, wherein, after the cutter cuts the printing medium up to the cut portion, the carriage is moved, so that the detection unit detects the cut portion.

6. The printing apparatus according to claim 4, wherein the cutter is disposed on a downstream in the conveyance direction relative to the printing unit as well as on an upstream side in the conveyance direction relative to the slitter.

7. The printing apparatus according to claim 1, wherein a starting point based on which the moving distance of the carriage is detected is a first origin position, and wherein a starting point based on which the moving distance of the slitter is detected is a second origin position.

8. The printing apparatus according to claim 7, wherein, based on the first moving distance and the second moving distance, the control unit determines a predetermined moving distance for the carriage to move in the intersecting direction from the first origin position to a position corresponding to the second origin position.

9. The printing apparatus according to claim 8, wherein the control unit determines the predetermined moving distance by subtracting the second moving distance from the first moving distance.

10. The printing apparatus according to claim 8, wherein the control unit determines a moving distance for the slitter to move in the intersecting direction to a position corresponding to a first position to which the carriage has been moved, by subtracting the predetermined moving distance from a moving distance for the carriage to move to the first position.

11. The printing apparatus according to claim 8, wherein a first mode and a second mode are set, so that, in the first mode, the predetermined moving distance is updated in a case where a predetermined condition is satisfied, and, in the second mode, the predetermined moving distance is updated in response to an instruction by a user, and wherein the first mode and the second mode are switchable.

12. The printing apparatus according to claim 7 further comprising:

a first flag member disposed on the carriage; and a first origin sensor configured to be able to detect the first flag member, wherein the first origin position, based on which the moving distance of the carriage is detected, is a position where the first origin sensor detects the first flag member.

13. The printing apparatus according to claim 7 further comprising:

a second flag member disposed on the slitter; and a second origin sensor configured to be able to detect the second flag member, wherein the second origin position, based on which the moving distance of the slitter is detected, is a position where the second origin sensor detects the second flag member.

14. The printing apparatus according to claim 1, wherein the control unit determines a moving distance for the carriage to move in the intersecting direction to an end portion of the image that is printed by the printing unit, and wherein the control unit moves the slitter to the end portion, based on the moving distance of the carriage.

15. The printing apparatus according to claim 1 further comprising:

a first encoder configured to detect the moving distance of the carriage; and a second encoder configured to detect the moving distance of the slitter.

16. A printing apparatus comprising:

a conveyance unit configured to convey a printing medium in a conveyance direction;

a printing unit configured to print an image on the printing medium;

a carriage having the printing unit and configured to be movable in an intersecting direction, which intersects the conveyance direction; and a slitter configured to be movable in the intersecting direction and cut the printing medium in the conveyance direction, wherein the printing apparatus includes a position detection member disposed on the slitter, a sensor disposed on the carriage and configured to be able to detect the position detection member, and a control unit configured to control a moving distance of the carriage or the slitter, at least based on a first moving distance that indicates a moving distance of the carriage at a timing where the sensor detects the position detection member after the carriage moves from a first origin position.

17. The printing apparatus according to claim 16, wherein, at the timing where the sensor detects the position detection member, the slitter is at a second origin position, which is a starting point based on which the moving distance of the slitter is detected, and wherein the control unit determines that a predetermined moving distance for the carriage to move in the intersecting direction from the first origin position to a position corresponding to the second origin position is the first moving distance.

18. The printing apparatus according to claim 16, wherein, after the control unit moves the slitter by a second moving distance from a second origin position, which is a starting point based on which the moving distance of the slitter is detected, the control unit moves the carriage, so that the carriage detects the position detection member.

19. A control method of a printing apparatus including a conveyance unit configured to convey a printing medium in a conveyance direction, a printing unit configured to print an image on the printing medium, a carriage having the printing unit and configured to be movable in an intersecting direction, which intersects the conveyance direction, a slitter configured to be movable in the intersecting direction and cut the printing medium in the conveyance direction, and a detection unit mounted on the carriage and configured to be able to detect a cut portion of the printing medium that has been cut by the slitter, the control method comprising:

cutting the printing medium after the slitter moves;

detecting the cut portion by the detection unit while the carriage moves; and moving the slitter or the carriage, based on a first moving distance and a second moving distance, the first moving distance indicating a moving distance of the carriage at a timing where the detection unit detects the cut portion, the second moving distance indicating a moving distance of the slitter moved to cut the printing medium.

20. A non-transitory computer readable storage medium storing a program which causes a computer to perform a control method of a printing apparatus including a conveyance unit configured to convey a printing medium in a conveyance direction, a printing unit configured to print an image on the printing medium, a carriage having the printing unit and configured to be movable in an intersecting direction, which intersects the conveyance direction, a slitter configured to be movable in the intersecting direction and cut the printing medium in the conveyance direction, and a detection unit mounted on the carriage and configured to be able to detect a cut portion of the printing medium that has been cut by the slitter, the control method comprising:

cutting the printing medium after the slitter moves;

detecting the cut portion by the detection unit while the carriage moves; and moving the slitter or the carriage, based on a first moving distance and a second moving distance, the first moving distance indicating a moving distance of the carriage at a timing where the detection unit detects the cut portion, the second moving distance indicating a moving distance of the slitter moved before the slitter cuts the printing medium.

* * * * *